US007730640B2

(12) United States Patent
Clark et al.

(10) Patent No.: US 7,730,640 B2
(45) Date of Patent: Jun. 8, 2010

(54) HIGH PERFORMANCE BOOT

(75) Inventors: Douglas E. Clark, Durham, NH (US); Stephen D. Opie, Arlington, MA (US); David E. Miller, Dayton, ME (US); Christopher J. Pawlus, Andover, MA (US)

(73) Assignee: The Timberland Company, Stratham, NH (US)

( * ) Notice: Subject to any disclaimer, the term of this patent is extended or adjusted under 35 U.S.C. 154(b) by 944 days.

(21) Appl. No.: 11/517,083

(22) Filed: Sep. 7, 2006

(65) Prior Publication Data

US 2007/0068043 A1 Mar. 29, 2007

Related U.S. Application Data

(60) Provisional application No. 60/715,535, filed on Sep. 9, 2005.

(51) Int. Cl.
*A43B 3/00* (2006.01)

(52) U.S. Cl. ..... 36/113; 36/72 R; 36/25 R; 36/73

(58) Field of Classification Search ..... 36/113, 36/25 R, 72 R, 72 B, 73, 77 R, 72
See application file for complete search history.

(56) References Cited

U.S. PATENT DOCUMENTS

| | | | | | |
|---|---|---|---|---|---|
| 737,189 | A | * | 8/1903 | Wright | 36/72 R |
| 875,560 | A | * | 12/1907 | Vaughan | 36/72 R |
| 987,054 | A | * | 3/1911 | Eves | 36/7.6 |
| 1,055,144 | A | * | 3/1913 | Decius | 36/7.6 |
| 1,056,091 | A | * | 3/1913 | Dickson | 36/72 R |
| 1,089,791 | A | * | 3/1914 | Remer | 36/72 R |
| 1,138,076 | A | * | 5/1915 | Brigance | 172/370 |
| 1,152,185 | A | * | 8/1915 | Koch | 36/72 R |
| 1,221,985 | A | * | 4/1917 | Golden | 36/128 |
| 1,376,635 | A | * | 5/1921 | Pierce | 36/72 R |
| 1,455,887 | A | * | 5/1923 | Salisbury | 36/95 |
| 1,592,692 | A | * | 7/1926 | Hackett | 36/72 R |
| 2,613,457 | A | * | 10/1952 | McLaughlin | 36/72 R |
| 4,693,022 | A | * | 9/1987 | Terhune | 36/132 |
| 5,301,442 | A | * | 4/1994 | Williams | 36/127 |
| 5,546,680 | A | * | 8/1996 | Barma et al. | 36/108 |
| 5,853,863 | A | | 12/1998 | Kim | |
| 5,926,977 | A | | 7/1999 | Sanders | |
| 6,159,590 | A | | 12/2000 | Kim | |

(Continued)

OTHER PUBLICATIONS

"PBI TurtleSkin," Warwick Mills, 2 pgs. © 2006.

*Primary Examiner*—Marie Patterson
(74) *Attorney, Agent, or Firm*—Lerner, David, Littenberg, Krumholz & Mentlik, LLP

(57) ABSTRACT

The present invention discloses various features and combinations thereof for use with articles of footwear such as boots. The boots are especially adapted for use on construction projects, and provide protection, support and comfort to the wearer. Numerous outsole configurations and styles are provided, which provide superior traction and a low center of gravity for enhanced balance. Different layers of materials provide puncture resistance, abrasion resistance, thermal insulation, waterproofing and other benefits. Protective and/or insulative plates may be utilized in the footwear for puncture protection or thermal insulation, for example. Shovel guards protect the wearer when using a tool, and toe tools permit the wearer to employ the boot as a tool of its own. Structural support cages chimney structures are also utilized for support and comfort.

19 Claims, 16 Drawing Sheets

U.S. PATENT DOCUMENTS 6,286,234 B1 * 9/2001 Smith, Jr. ..... 36/131
6,681,500 B2 1/2004 Moretti
6,720,277 B1 4/2004 Howland
6,874,251 B2 4/2005 Moretti
2004/0255486 A1 12/2004 Pawlus et al.
2005/0081405 A1 4/2005 Healy
2005/0138846 A1 * 6/2005 O'Connor ..... 36/72 B

* cited by examiner 414
430
422
423
408

400
420
402
404
416
418
406
414
410
408
422
423
410
408
414
423
412

600
620
602
604
616
618
619
614
626
606
610
608
622

608
610
610
622
610

614
624
628
616
626
632
630

700
702
704
706
708
710
712
714
714'
716
716'
718
720
722
724
726
728
734
11.0
28.0

731
730
734
732
726
5.0 mm
734
7A
56.0 mm
39.0
7A-7A
7A 732
731

714
718
A
A
736
738
738
736
720
716
B
B 3.0
3.0
0.7
0.7
C
C
0.5
0.5
30°
0.5
0.7

C-C
Raise starts
0.5 above surface
25°
736

B-B
740
28.0
10.0
714
744
742
716
748
746

A-A 914
915
916
918
920
924
926
A
B
C
Timberland

A-A 1014
1016
1010

1000
1014
1016
1012
1006
1024
1002
1004
1010

A-A
1020
1018
1022
1008
37b

1100

HIGH PERFORMANCE BOOT

CROSS-REFERENCE TO RELATED APPLICATIONS

The present invention claims the benefit of the filing date of U.S. Provisional Patent Application No. 60/715,535, filed Sep. 9, 2005, is related to U.S. patent application Ser. No. 11/206,237, filed Aug. 17, 2005, to U.S. Provisional Patent Application No. 60/714,619, filed Sep. 7, 2005, and to U.S. patent application Ser. No. 11/516,859, entitled "Extreme Service Footwear," filed concurrently herewith, the entire disclosures of which are hereby expressly incorporated by reference herein.

BACKGROUND OF THE INVENTION

The present invention relates generally to articles of footwear and, more particularly, to footwear used as workboots in, for example, construction and related industries. Of course, the footwear of the present invention is not limited to such utilitarian functions but can be used in any footwear setting, including, for example, routine footwear environments such as everyday footwear or fashion footwear.

Conventional work boots offer the wearer little protection against the hazards that are commonly encountered on job sites. Known boots typically have all leather uppers, a construction that offers the wearer's feet little protection from punctures, cuts and other dangers. All leather uppers also leave the wearer's foot hot and uncomfortable, especially in warmer climates.

Leather uppers typically fail to protect the wearer from water, causing the wearer's foot to become wet when the boot is exposed to water, such as when it is raining or when walking through puddles. Wet feet can be extremely uncomfortable for the wearer, especially over long periods of time. This can lead to skin irritation, fungal infections, and the like.

The outsoles of conventional work boots as known in the art are similarly flawed. Conventional outsoles for work boots are typically very thick, which raise the wearer's foot high off the ground. This height leads to instability and possible injury due to easily twisted ankles.

Work boots also typically include flexible outsoles that cause the wearer's foot to bend over the arch or middle portion of the boot when the wearer walks on narrow footholds, such as ladders. Flexible outsoles also bend when a user is operating tools that require the wearer's foot, such as a shovel. This bending of the boot and the wearer's foot is uncomfortable for the wearer and may lead to injuries such as muscle damage over time.

Conventional work boots also fail to provide adequate protection from kicking hard objects without damaging the boot. While some boots provide steel toe protection, using these boots to kick hard surfaces damages the leather upper.

Thus, there is a need for articles of footwear that will protect the wearer from punctures and water and provide sufficient rigidity to reduce bending of the boot over narrow surfaces. There is also a need for a boot with a rigid toe that can be used to perform construction-related tasks without damaging the boot.

The present invention addresses these needs. The present invention is an article of footwear that utilizes a number of features to create an ideal work boot.

SUMMARY OF THE INVENTION

In accordance with embodiments of the present invention, articles of footwear as discussed herein may comprise numerous elements for comfort, flexibility, support, protection and traction. The footwear may include an outsole, an upper, a shovel guard, a toe tool, a protective heel cover and an ankle protector. The outsole is desirably a low profile outsole having a first surface for contacting the ground and having traction elements thereon and a second surface remote from the first surface. The upper is attached to the second surface of the outsole. The upper includes a shaft section having a breathable mesh overlay, a waterproof vamp section, and a waterproof extended eyestay section. The extended eyestay section is at least partly disposed over the shaft. The shovel guard is of a rigid material, and is disposed on an instep section of the article of footwear adjacent to the outsole. The toe tool is disposed along a toe section of the article of footwear and has a substantially planar exterior front surface. The protective heel cover is disposed along a heel section of the upper. The ankle protector is positioned on at least one of the medial and lateral sides of the shaft of the upper. These and other features are described in detail below and are shown in the accompanying drawings.

In accordance with another embodiment of the present invention, an article of footwear includes protective and tool features. For instance, the footwear preferably includes an outsole having a first surface for contacting the ground and having traction elements thereon and a second surface remote from the first surface. An upper is attached to the second surface of the outsole. The upper includes a shaft section and a base section. The shaft section substantially encircles a portion of the wearer's leg and the base section forms an enclosure region for the wearer's foot. A shovel guard of rigid material is disposed on an instep section of the article of footwear adjacent to the outsole, which permits the wearer to press down on a shovel without injuring his or her instep. A toe tool is disposed along a toe section of the article of footwear and has a substantially planar exterior front surface.

In one alternative, the shovel guard extends substantially from the medial side to the lateral side of the article of footwear. In an example, the shovel guard is desirably formed on the instep section between a forefoot section of the outsole and a rearfoot section of the outsole. Here, the shovel guard does not include any of the traction elements thereon.

In another alternative, the toe tool is integral with the outsole. However, the toe tool may instead be integral with a midsole member of the article of footwear.

In a further alternative, the substantially planar exterior front surface is generally perpendicular to the shovel guard. In this case, the toe tool preferably further includes generally planar first and second side surfaces disposed on either side of the front surface.

In another alternative, the article of footwear further includes a protective heel cover disposed along a heel section of the upper. The protective heel cover comprises a rigid material. In this case, medial and lateral sides of the outsole preferably wrap upwards along at least insole and metatarsal regions of the article of footwear and at least some of the traction elements are disposed on the upwardly wrapped medial and lateral sides of the outsole. In yet another alternative, at least a portion of the protective heel cover includes a rubberized outer finish thereon. In a further alternative, the article of footwear further comprises an ankle protector on at least one of the medial and lateral sides of the upper shaft.

In accordance with a further embodiment of the present invention, an article of footwear includes a low profile outsole having a first surface for contacting the ground and having traction elements thereon and a second surface remote from the first surface. An upper is attached to the second surface of the outsole. The upper includes a shaft section and a vamp section. The shaft section substantially encircles a portion of the wearer's leg and the vamp section forms an enclosure region for the wearer's foot. The shaft section has a first height and the vamp section has a second height, wherein the first height is greater than the second height.

In one alternative, the vamp section of the upper is waterproof. In this case, the shaft section preferably includes a first layer of breathable ventilating material and a second layer of protective material at least partly overlying the first layer. The second layer desirably comprises a puncture resistant and cut resistant material. In an example, the second layer is flame retardant.

In a further alternative, the article of footwear is a boot, the low profile outsole has a non-breasted heel, and the traction elements are disposed along a forefoot section of the outsole. Here, the traction elements wrap upwards on at least one of the medial and lateral sides of the outsole. In an example, an instep section of the outsole includes medial and lateral extended sections that wrap along an instep region of the vamp section of the upper. In this case, the medial and lateral extended sections desirably include a plurality of grooved channels therealong. Preferably the traction elements are less than about 1.5 mm in height, providing further benefit to the low profile outsole.

In accordance with another embodiment of the present invention, an article of footwear includes an outsole having a first surface for contacting the ground and having one or more traction elements thereon and a second surface remote from the first surface, as well as an upper including a shaft section and a base section. the shaft section substantially encloses at least a portion of the wearer's leg and the base section forms an enclosure region for the wearer's foot. The article of footwear also includes a support cage disposed between the second surface of the outsole and the base section of the upper. The support cage includes a plurality of medial and lateral fingers that extend over mid and forefoot areas of the base section of the upper.

In one alternative, the support cage comprises an integrally formed foot cradle having the plurality of medial and lateral fingers. Here, the plurality of medial and lateral fingers are desirably flexible enough to work independently of one another and are operable to adjust to the contours of the wearer's foot. The article of footwear in this case preferably further comprises a plurality of eyelets disposed on at least some of the medial and lateral fingers so that a lace of the article of footwear can be adjusted in combination with the fingers to achieve a desired fit.

DETAILED DESCRIPTION

A preferred embodiment of an article of footwear according to the present invention will now be described with reference to the figures.

Figure 1:
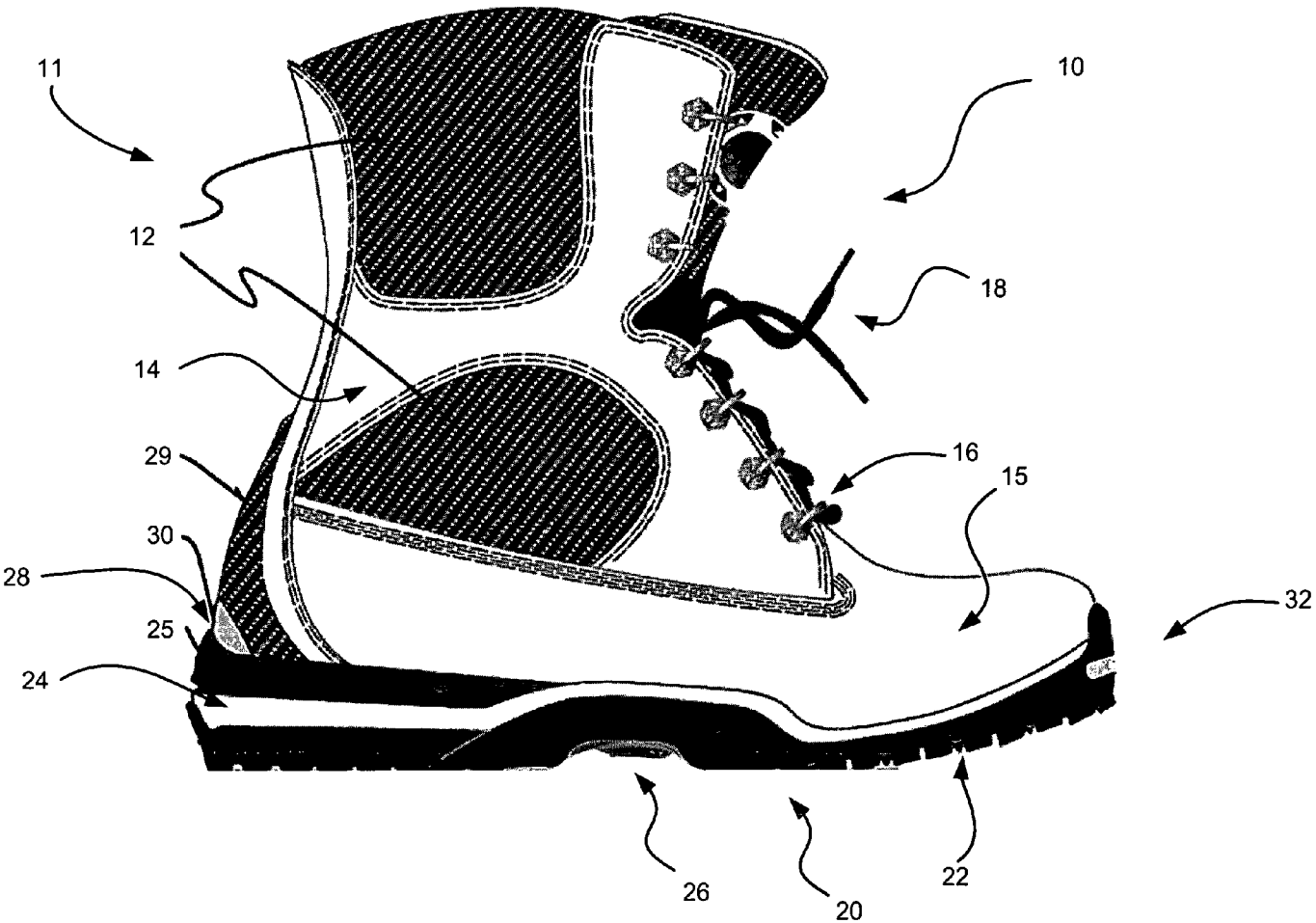
FIG. 1 depicts a side view of a boot according to a preferred embodiment of the present invention.

A side view of an article of footwear 1, such as a boot, is shown in FIG. 1. While depicted as a boot such as a workboot, the article of footwear 1 may be configured as another type or style of boot or other form of footwear. As depicted, the boot 1 preferably has an upper 10 defining a cavity adapted to receive a wearer's foot. The upper is flexible, meaning the upper easily bends to allow the wearer's ankle to move freely while secured within the boot. The upper 10 may comprise one or more distinct regions and/or layers containing different material. For instance, one of the regions may be a breathable material, meaning that the material preferably includes holes or porous material such as a mesh to allow airflow between the cavity of the boot 1 containing the wearer's foot and the environment outside the boot 1. Another region or regions may comprise a protective and/or supportive material such as leather, waterproof leather, synthetic, non-porous fabric or other known materials adapted for footwear uppers, such as suede or canvas.

The upper 10 depicted in FIG. 1 includes a shaft 11, which preferably extends from the ankle area to the top line of the collar on the upper 10. The shaft 11 is illustrated as having a material 12, which is preferably a breathable material. The material 12 may comprise, for instance, a mesh overlay such as a stretch mesh for flexibility and ventilation and/or a protective fabric for enhanced durability and protection. The mesh overlay is desirably nylon, e.g., a stretch nylon that is lightweight and tear resistant. A puncture resistant mesh may also be used. One or more regions of material 14 preferably cover sections of the shaft 11. In a preferred example, a single region of material 14 covers substantially all of the shaft 11, and may also be incorporated into the tongue or gusset of the upper 10. The material 14 is preferably waterproof and may be, for instance, leather. A vamp region of material 15 is also illustrated. The material 15 is desirably waterproof, and may be the same or different from the material 14.

The material 12 may be treated with a water repellent to allow for airflow in and out of boot 1 while still offering moisture and liquid repellency in the mesh part of the upper. Foam or other materials may also be included in or with material 12, material 14 or elsewhere for padding and protection. Preferably, an outer layer is comprised of mesh and an inner layer is comprised of foam, for instance reticulated or perforated foam for comfort as well as air flow. More preferably, these layers of mesh and foam may be disposed along at least the collar and tongue sections of the upper 10. As shown, portions of the material 12 are covered by the material 14. The material 12 provides ventilation, or flow of air between the outside environment and the cavity containing the foot of the wearer. The material 14 provides support and structure to the upper 10. As seen in the figure, material 14 may include an eyestay section or extended eyestay section having eyelets, receptacles or other fastening members 16 thereon for receiving lace 18. The eyestay section provides structure and protection to the exterior of the boot 1 without compromising comfort and flexibility of the shaft 11. Desirably, the material 14 includes a durable material that provides protection from environmental conditions, such as cold, wind, surface water, etc.

Alternatively, either material 12 or material 14 of the upper 10, or both, may be constructed of a puncture and cut proof material as known in the art. All or part of the upper 10, such as the material 14, is preferably made of a lightweight puncture and cut resistant material. The puncture resistant upper 10 may fully resist punctures. It preferably also can absorb an impact inducing force by yielding but not breaking in response to the force. Thus, the upper 10 desirably for all but the strongest forces will not fully yield so as to break the integrity of the upper 10 at the side proximate to the foot of the wearer. The puncture resistant upper 10 prevents sharp objects that are thrust toward the footwear from contacting the foot or ankle of the wearer. By way of example only, the upper 10 may include high-strength materials such as aramid fibers. Para-aramid fibers, which have a slightly different molecular structure from aramid fibers, also provide outstanding strength-to-weight properties, high tenacity and high modulus. DUAL MIRROR® by Gentex is an aluminum and aramid laminate used for extreme flame and heat protection. Fibers such as NOMEX® or KEVLAR® brand fibers from E. I. Du Pont de Nemours and Company are aramid blends that include the flame and heat resistance in a plain weave or rip stop material. Treated materials, such as leather or synthetics can be finished with a puncture and/or cut resistant finish. Tightly woven aramids or para-aramids such as E.I Du Pont de Nemours and Company's SNAKE ARMOR® can be employed for fire resistance and added puncture resistance. Polyethylene yarns also are suitable as puncture resistant materials. The material(s) of the upper 10 may also be made up of layered, densely woven fabrics to prevent puncture as disclosed in U.S. Pat. No. 6,720,277, the entire disclosure of which is hereby incorporated by reference herein. In another example, the material used for the upper 10 may be made cut and puncture resistant by utilizing a material composed of platelets and rivets as disclosed in U.S. Pat. No. 6,159,590, the entire disclosure of which is hereby incorporated by reference herein. The aforementioned puncture-resistant materials, as known to those skilled in the art, provide protection to the wearer of the boot 1 from puncture or cuts from sharp objects or abrasive materials. Thus, the upper 10 gives the wearer protection against sharp objects that are commonly found on construction sites, such as nails and screws, utility knives, broken glass, scrap metal, and saw blades. The upper 10 of the boot 1 material may also include one or more layers or coatings of a partially or fully ceramic material or coating for heat or fire resistance.

The upper 10 is preferably made of a material that is sufficiently flexible to allow the wearer to easily move their ankle or other portion of the leg or foot with very little resistance. This upper flexibility reduces stress on the ankle and leg muscles of the wearer and promotes comfort. Flexibility may be derived in multiple ways, including not only the upper material, but may also be derived from structural integration of pleats, grooves, or other known structures into the upper 10 that enhance flex.

The material used for the flexible upper 10 may also be a flame retardant material, including some of the materials discussed above, such as DUAL MIRROR and SNAKE ARMOR brand materials, as well as TURTLESKIN brand materials manufactured by Warwick Mills and known in the art. Such flame retardant materials prevent burns to the foot and leg of the wearer if the wearer is forced to traverse flames while wearing the boot 1, or if the boot 1 is used in environments with open flames, if welding equipment is in use, etc. Other manufacturers, such as Baltex or W. Ball & Son, Ltd., of Derbyshire, U.K. also provide fabrics that are puncture resistant, tear resistant, abrasion resistant and/or flame retardant.

As discussed above, at least part of the upper 10 may be waterproof, such as material 14, which allows the wearer to traverse wet environments without permitting water to enter the boot 1. This will be useful to the wearer if the wearer walks through rivers, swamps, snow, or other wet terrain, including construction sites and the like. The upper 10 is preferably also hydrophobic, meaning that it does not retain water. This helps to reduce the overall weight of the boot 1 by preventing it from becoming water logged, thereby reducing wearer fatigue due to lifting heavy footwear. Materials such as hydrophobic expanded polytetrafluroethylene ("PTFE"), commonly sold under the mark GORE-TEX®, or EVENT brand materials manufactured by BHA Technologies, Inc. are known in the art that individually or in combination are waterproof or hydrophobic.

Alternatively, the upper 10 of the boot 1 may be made of a plurality of layers of material which are adhered or otherwise attached to each other. The upper 10 may have, for example, a waterproof outer layer with a puncture proof inner layer. The various layers may partially or completely overlap each other. The layers may be attached to each other using nylon stitching or other known stitching commonly used in the footwear arts. These layers may provide the boot 1 with various characteristics which may prove useful to the wearer in different situations. For example, a wearer that commonly works with sharp objects may require a puncture proof boot while a wearer that commonly works outdoors may require a waterproof boot. Other materials such as neoprene and LYCRA brand stretch fiber, manufactured by Invista, may also be employed in one or more layers or sections of the upper 10 to help ensure a secure fit of the boot 1 to the wearer's foot.

The material 12 of the upper 10 preferably includes ventilation holes which provide ventilation to the wearer's foot. Another potential configuration for ventilation of the wearer's foot is a chimney structure that allows air to escape from the lower portion of the boot through one or more chimneys in the tongue or side of the boot as described in U.S. patent application Ser. No. 11/432,232, entitled "Chimney Structures for Footwear and Foot Coverings," the disclosure of which is hereby incorporated by reference herein. The chimneys may be partly or completely covered by a mesh liner or other breathable material, or may be partly or substantially covered by a non-porous or otherwise non-breathable material, as discussed in the aforementioned U.S. patent application.

As mentioned above, the upper 10 preferably has lace eyelets, receptacles or other fastening members 16 attached thereto which accept the lace 18. The eyelets 16 may be made of, for example, metal, plastic, or rubber or equivalent material and are adapted to allow the lace 18 to pass through easily in order to securely hold the boot 1 to the foot and ankle of the wearer.

The boot 1 has an outsole 20 preferably made of a high-traction rubber as is known in the art to enhance traction with the ground. Such high traction materials are known to be adapted to different external environments such as oil or other petrochemicals, water or any other compound known to adversely affect outsole traction. Outsole 20 includes the portion of the boot 1 that contacts the ground during routine locomotion and to which other portions of the boot 1 such as the midsole or the upper 10 may be attached. The outsole 20 may include a plurality of lugs 22 on the outsole bottom where contact is made with ground during common gait to provide traction to the wearer. The lugs 22 may be articulating lugs such as those described in U.S. Patent Application Publication No. 2005/0081405, the entire disclosure of which is hereby incorporated by reference herein. Alternative lug and traction element configurations will be discussed in detail below.

The outsole 20 of the boot 1 may also be made of a high-durability compound, such as rubber, as known in the art to prevent excessive wear of the outsole 20. This allows the boot 1 to last for a long period of time even during periods of extended use. The high durability material also aids in the protection of the user against puncture wounds from sharp objects that may be stepped on by the user. For example, the outsole 20 may comprise a layer of ethyl vinyl acetate ("EVA") foam with a layer of high-density rubber on the outside. The EVA foam can be selected to have a predetermined level of cushioning. However, other materials commonly used in known outsoles may also be used with the outsole 20.

The boot 1 may further comprise a midsole 24 which is preferably made of EVA, polyurethane ("PU"), or other suitable material commonly used in midsoles, insoles, and footbeds. The midsole 24 may connect the upper 10 with the outsole 20 of the boot 1 in a water-tight fashion in order to provide the wearer with protection from water, even when the wearer stands in a certain depth of water. A heel stabilizer or heel plate 25 may be made of a thermoplastic polyurethane ("TPU"), hard plastic, nylon, or other high impact plastic to provide stability and protection for the wearer.

The outsole 20, midsole 24, heel plate 25 and/or upper 10 of the boot 1 may each be coated with a color different than the underlying material of the component, e.g., the outsole 20, the midsole 24 or the upper 10, in order to show the wearer if the outsole 20, midsole 24, or upper 10 has been cracked, chipped, or compromised in any way. Alternatively, different color schemes may be employed on the outsole 20, the midsole 24, heel plate 25 and/or the upper 10 for other purposes, such as fashion or safety. A reflective material or coloration may be used for safety purposes.

The boot 1 preferably includes a shovel guard 26 on the surface of the outsole that faces the ground during routine locomotion. The shovel guard may extend completely from one side of the boot 1 to the other or may alternatively comprise a rigid member positioned in the center of the outsole or on one or both sides of the outsole. The shovel guard 26 preferably comprises a piece of rigid material such as steel, TPU, KEVLAR brand synthetic fibers or the like. The shovel guard 26 may also be made of other plastics, rubbers, or similar materials. By way of example only, the shovel guard 26 enables the wearer to press down on a shovel or other tool that has a hard surface, such a shovel stuck in the ground. The shovel guard 26 prevents or minimizes the outsole 20 and midsole 24 from transmitting force to the foot or yielding from force of a tool in contact with the outsole 20, which may be uncomfortable for the user. The shovel guard 26 also absorbs the shock of the shovel and dissipates the shock through the outsole 20. The shovel guard 26 is also useful when the user is climbing ladders or walking on rebar, for example.

The shovel guard 26 is preferably located along the instep section of the boot 1 between the forefoot portion and the heel portion thereof, such as below the arch of the wearer's foot. The shovel guard 26 may be distinct component separate from the outsole 20 and/or the midsole 24. Alternatively, the shovel guard 26 may be formed as part of the outsole 20 or the midsole 24. The shovel guard 26 desirably does not include any lugs 22, although a logo or design of low profile may be placed thereon. Such a logo or design is preferably of less than about 1 mm in height; alternatively, it may be embossed on, recessed in, or encased within the shovel guard 26. The shovel guard 26 may also be coated with a metallic finish.

The surface of the shovel guard 26 opposite to the outsole-contacting surface of the shovel guard 26 is preferably substantially or completely flat, but may include ridges on the sides or bottom of the shovel guard 26 in order to enhance traction for the wearer while traversing a plurality of different terrains or while contacting a plurality of kinds of tools. In an alternate embodiment, the surface of the shovel guard may be rounded or otherwise contoured to interact with a specific tool, such as a shovel, jackhammer, etc.

In an alternative embodiment, a plate of rigid material may be imbedded into the outsole 20 of the boot or inserted over the outsole 20 of the boot and under the midsole 24, or between the midsole 24 and a footbed (not shown). The plate may be made, for example, of steel or another metal, TPU or other hard plastic, or the like. Alternatively, the plate may be integrated as part of the midsole, as will be explained in more detail below with respect to FIGS. 4-6.

A footbed (not shown) may be utilized with the boot 1. The footbed may be formed from resilient materials such as EVA or PU foams or other such materials commonly used in shoe midsoles, insoles or sockliners. The footbed may be permanently or removably inserted into the boot 1.

Preferably, the footbed to be used in an article of footwear according to the present invention is part of an adjustable footbed system which includes interchangeable cartridges that help adjust the volume inside the article of footwear to better fit the foot. Embodiments of adjustable footbeds are disclosed in U.S. Provisional Patent Application Ser. Nos. 60/623,475 and 60/667,970, both of which are hereby incorporated by reference in their entirety herein.

For instance, FIGS. 2(*a*)-(*c*) in both the 60/623,475 and 60/667,970 provisional applications illustrate an adjustable, interchangeable cartridge system 200. As stated in the provisional applications, the cartridge system 200 includes a footbed, insock, or other shaped area 202 for supporting portions of the foot, as well as a cartridge or resizing member 204. As seen in the exploded and assembled perspective views of FIGS. 2(*b*)-(*c*), the cartridge 204 is insertable into the footbed 202 and is secured in place by releasable fastening means as will be described below. The footbed 202 need not extend the entire length of the foot from the toes to the heel. For instance, the footbed 202 may only be positioned in the toe region of the shoe, or extend from the toes through part or all of the instep region of the sole. The footbed 202 and/or the cartridge 204 may be formed from resilient materials such as EVA or PU foams or other such materials commonly used in shoe midsoles, insoles or sockliners. One or both of the footbed 202 and the cartridge 204 may be formed of multiple material layers, regions and/or segments, which may each have a different thickness and/or a different rigidity. For example, the footbed 202 may comprise multiple layers of different rigidity. In this case, a first layer may be, e.g., an EVA layer having a hardness of 20 on the Asker C scale, a second layer may be a PU layer having a hardness of 30 Asker C, and a third may a thermoplastic PU layer having a hardness of 40-50 Asker C. Alternatively, the footbed 202 may have different levels of rigidity in the forefoot, instep and heel regions, respectively. The footbed 202 could also have a first segment about the first metatarsal of a first rigidity and a second segment about the fifth metatarsal of a second rigidity.

Furthermore, as seen in FIGS. 2(*b*) and 2(*c*) of the provisional applications, the fastening means preferably includes one or more tabs, protrusions, plugs or other connection members 212 on the cartridge 204 that engage respective slots or recesses 214 on the footbed 202. The user may line up the tabs 212 with the slots 214 and then push the tabs 212 fully into the slots 214. The tabs 212 preferably extend at least 5.0 mm away from the body of the cartridge 204. Shorter lengths may be appropriate if fastening can be achieved. More preferably, the tabs 212 are on the order of 12.0 mm long, which provides ample connectivity even when the foot is fully flexed during walking or running. Desirably, the tabs 212 are at least 5.0 mm wide for proper fastening, although as shown the tabs 212 are approximately 15 mm wide. When the tabs 212 are fully inserted into the slots 214, the cartridge 204 is securely connected to the footbed 202. The tabs 212 may be integrally formed with the rest of the cartridge 204, for example as part of a molding process. Alternatively, the tabs 212 may be fabricated apart from the body of the cartridge 204 and may be attached to the body using, for instance, an adhesive material or glue. In this case, the tabs 212 may be the same or a different material from the cartridge 204, such as EVA, PU or TPU. Moreover, the ends of the tabs 212 may have a "lip" or overhang to assist in a secure and releasable connection to the slots 214.

Alternative adjustable footbed configurations that are also suitable for use with embodiments of the present invention include those disclosed in the aforementioned "Military Boot," provisional patent application. For instance, the adjustable footbeds may include a support saddle and/or drainage holes for removal of water or other fluids.

Alternatively, the footbed may be formed of one or more material layers, regions and/or segments, which may each have a different thickness and/or a different rigidity. For example, the footbed may comprise multiple layers of different rigidity. Alternatively, the footbed may have different levels of rigidity in the forefoot, instep and heel regions, respectively. The footbed could also have a first segment about the first metatarsal on the medial side of the forefoot of a first rigidity and a second segment about the fifth metatarsal on the lateral side of the forefoot of a second rigidity. The footbed is preferably removable, and desirably includes two or more layers. In a preferred example, one layer comprises EVA foam such as compression molded EVA ("CMEVA"), and another layer includes an antimicrobial component.

Returning to FIG. 1, the rear portion of the boot 1 preferably has one or more ridges, recesses or lips 28 which allow the user to easily remove the boot 1 by placing one foot in front of the other, placing the toe of the rear foot on the ridge 28 of the boot 1 on the front foot, and exerting a force opposite to the direction of movement needed to remove the foot from the boot 1.

The rear portion of the boot 1 preferably also includes a band of reflective material 30. This reflective material 30 will reflect the light, for instance from oncoming hazards such as vehicles, helping to identify the wearer and avoid injury. This additional visibility will contribute to the wearer's safety when the boots are worn around motorized vehicles such as cars, trucks, trains, heavy equipment, or aircraft.

The rear portion of the boot 1 preferably also includes a protective heel cover or heel rand 29. The protective heel cover 29 is preferably made of a rigid material such as plastic, steel or the like, and is affixed to the rear of the boot 1, at least partly surrounding the portion of the upper 10 that covers the heel of the wearer in order to provide protection to the rear of the wearer's foot as well as rigidity and support to the boot 1. The protective heel cover 29 will protect the heel of the wearer from impact such as from platforms on rollers, wheels, or casters for moving heavy objects. The protective heel cover 29 preferably comprises a nonabrasive material and may be translucent. For example, reflective material 30 may be disposed on or in the protective heel cover 29 and covered by a see-through covering, such as a plastic. The protective heel cover 29 preferably extends from the top of the outsole 20, meaning the side of the outsole 20 adapted to be attached to the upper 10, to approximately the midline of the upper 10, extending and covering the heel and back portion of the upper 10 as to protect the calcaneus and Achilles tendon areas of the wearer's foot. The protective heel cover 29 may be slightly curved to wrap slightly around the heel of the wearer in order to provide some protection to the wearer from side impact.

Figure 2C:
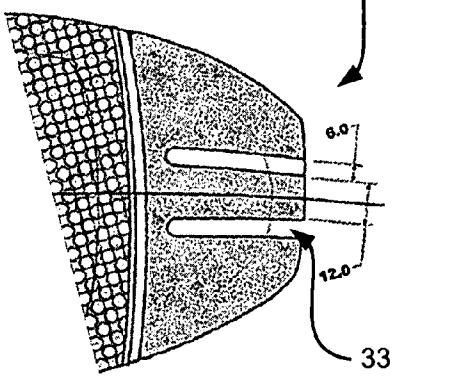
FIGS. 2A-C depict a toe tool according to a preferred embodiment of the present invention.
Figure 2B:
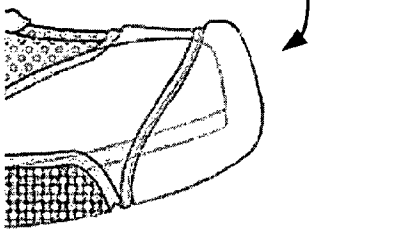
Figure 2A:
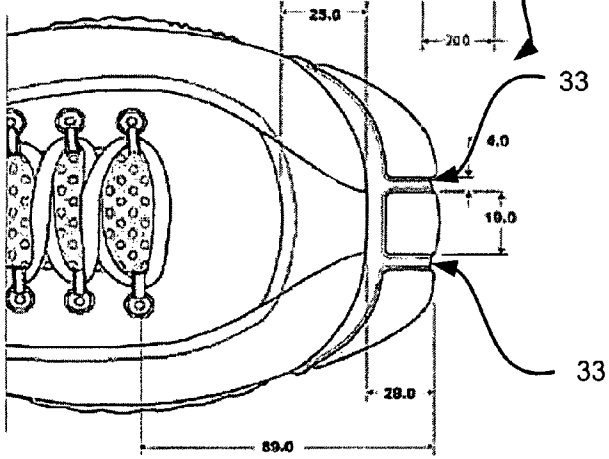

As depicted in respective top perspective, side and bottom views of FIGS. 2A-C, the boot 1 or other article of footwear preferably also includes a toe tool 32. The toe tool 32 desirably comprises a solid piece of high-strength or otherwise durable material, such as a TPU, steel, KEVLAR, rubber, ceramic or the like. The toe tool 32 is preferably integrated into the outsole 20 of the boot and is disposed along the toe portion of the boot 1. In alternative embodiments, for instance, the toe tool 32 may be integrated with the midsole 24 of the article of footwear. Alternatively, the toe tool 32 may also be affixed to the outside of the outsole 20 or the midsole 24 using glue, cement, epoxy, or other adhesive. The toe tool 32 may be preferably formed substantially or completely flat along the exterior front surface which allows for greater comfort and stability when the wearer is kneeling down due to increased surface contact and pressure distribution. The toe tool 32 is useful to the wearer for numerous construction-related uses, such as kicking in nails or other hard objects, such as beams of wood. The toe tool 32 may also be used for other construction related uses such as moving objects into position prior to securing the object with a suitable fastening device. As an example, a beam of wood may be held in place with the toe tool prior to nailing the beam. As shown in FIGS. 2A and 2C, the toe tool 32 may include recesses or grooves 33 thereon.

In an alternative, the toe tool 32 may be integral with a plate inserted into the insole of the boot 1. The plate may be made of TPU, steel, KEVLAR, or another rigid and/or durable material. This will provide strength for the toe tool 32 and also dissipate the shock absorbed by the toe tool into the rest of the boot 1 when the toe tool 32 is used to strike hard surfaces.

Alternatively, the toe tool may be formed as part of a one piece outsole 20 or may be formed as part of a protective toe cap or cover.

Figure 3A:
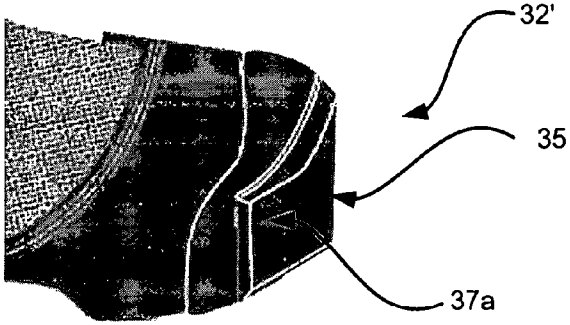
FIGS. 3A-B depict another toe tool according to a preferred embodiment of the present invention.
Figure 3B:
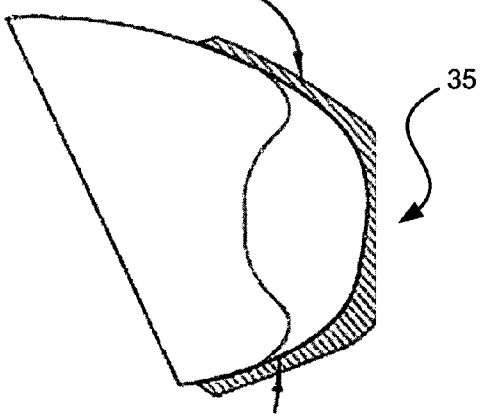

FIGS. 3A and 3B illustrate side and top views, respectively, of another embodiment of a toe tool. As seen in these figures, toe tool 32' includes a substantially planar front surface 35 along the frontmost portion thereof. The front surface 35 is desirably generally perpendicular to the shovel guard 26. The toe tool 32' also includes generally planar side surfaces 37*a* and 37*b* on either side of the front surface 35.

In a further embodiment, the toe tool 32 or 32' may be magnetized for ease of hammering or striking nails or other metal objects. Alternatively, the toe tool 32 or 32' may have a notch, recess or other receptacle so that the user may insert a nail into the front of the boot and kick it into a substance.

The toe tool 32 or 32' may be a different or contrasting color than the upper or outsole of the boot, or may be otherwise visually distinguishable. A reflective coating or colorant may be used for safety. Alternatively, the external surface of the toe tool 32 or 32' may be colored a different color than the rest of the toe tool such that if the toe tool 32 or 32' become cracked, chipped, or otherwise compromised, the underlying color is highly visible and indicates to the user that replacement or repair is necessary.

Figures 4A, 4B:
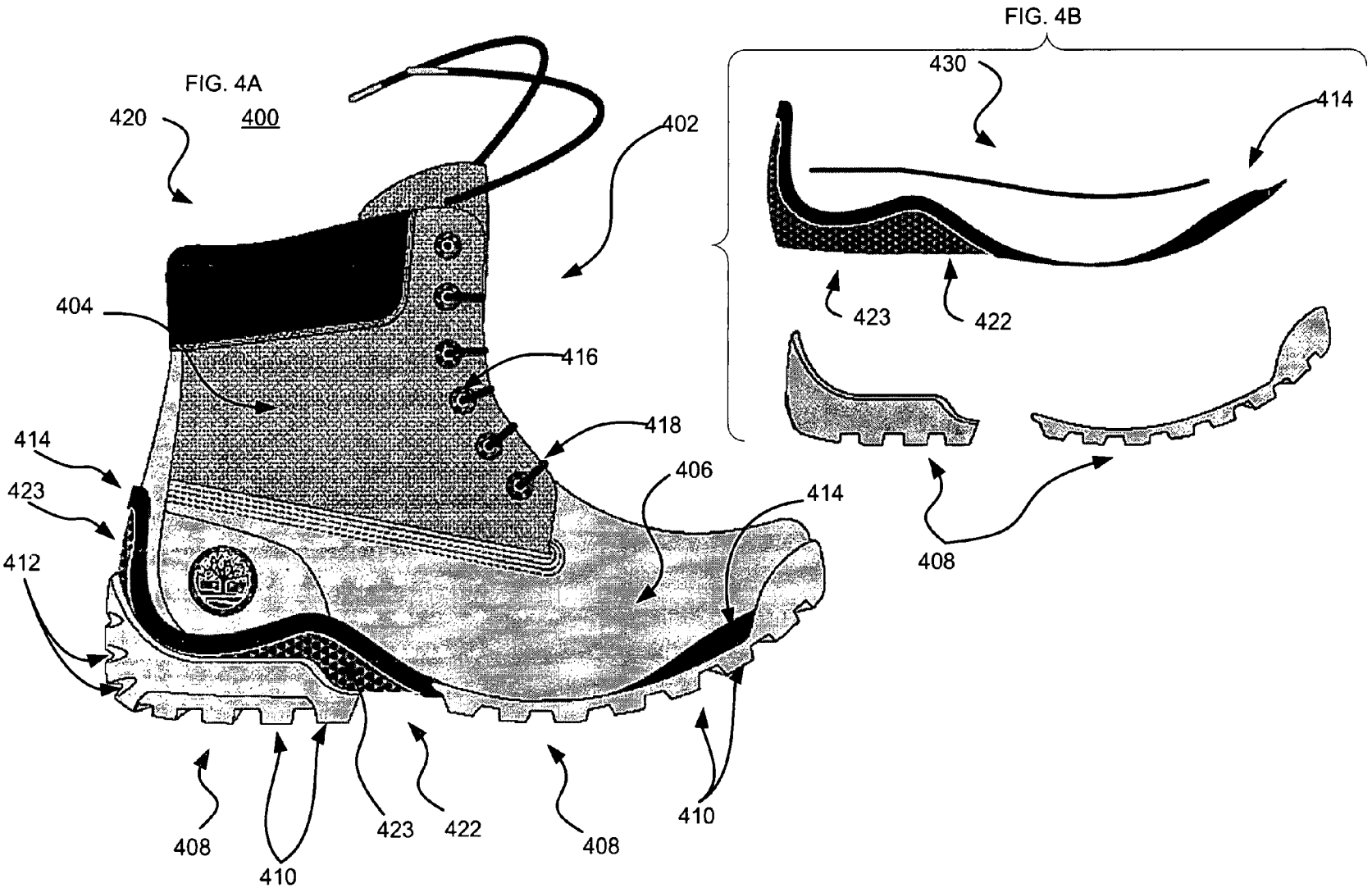
FIGS. 4A-B depict an alternate embodiment of an article of footwear according to the present invention.

FIG. 4A shows an alternate embodiment of an article of footwear 400 according to the present invention. The article of footwear 400 preferably comprises a boot, although other styles of footwear are possible. The boot 400 has an upper 402 which includes a top region 404. The top region 404 is preferably made up of a puncture and cut proof material as discussed earlier. The top region 404 may also be waterproof and fire retardant as discussed above. The upper 402 preferably also comprises a lower region 406 which may be made of leather or the same material as the top region 404. In one embodiment, the lower region 406 is waterproof while the upper region 404 is breathable and may be water repellent, which makes the boot 400 waterproof in only certain depths of water which do not exceed the topline of the waterproof area of the upper 402. This will provide the wearer with breathable, comfortable and water resistant footwear. Here, top region 404 may include, for example, a mesh fabric or other permeable material, as well as one or more other layers of, for instance, padding. In one embodiment, the bottom third of the article of footwear 400 is waterproof while the rest of the article of footwear 400 is breathable and not waterproof. In another embodiment, the bottom quarter of the article of footwear 400 is waterproof. In yet another embodiment, the article of footwear 400 is waterproof only below the ankle portion or below the eyelets, for instance only along the lower region 406. The upper 402 preferably also comprises a collar 420 which provides comfort, for example, around the ankle region of the wearer.

The top region 404 may include a plurality of eyelets 416 adapted to receive a lace 418 therethrough for securing the boot 400 to the foot of the user. The eyelets 416 may be of any style or configuration.

The boot 400 preferably also comprises an outsole 408 with a plurality of lugs 410 for traction. The outsole 408 may be one or more sections, such as the two sections shown in FIG. 4A. A midsole 414 is preferably disposed between the outsole 408 and the upper 402. The midsole 414 may comprise, by way of example only, polyurethane, EVA, or PVC foams. A shovel guard 422, which may be the same or similar to the shovel guard 26 discussed above, preferably has a substantially flat bottom. The shovel guard 422 may also form part of a protective plate 423 as best depicted in FIG. 4B. The protective plate 423 provides the wearer with stability and protection in the heel region as well as extending forward underfoot, which forms the shovel guard 422.

The outsole 408 preferably also has a heel section with traction elements 412. The heel section is preferably generally rounded from the bottom of the outsole 408 to the rear of the boot 400. The traction elements 412 are especially beneficial when the boot 400 is used on non-planar surfaces, or when the wearer raises the toe portion of the boot 400 up and the heel section is the primary contact point with the ground.

In the embodiment shown in FIG. 4A, the shovel guard 422 is preferably integrally formed as a section of the protective plate 423. However, the shovel guard 422 may be a separate piece. Also, the midsole 414 may be a piece separate from the protective plate 423, or both components may be formed as an integral unit. FIG. 4B illustrates an exploded view of the outsole 408, the protective plate 423 and the midsole 414.

Figure 5:
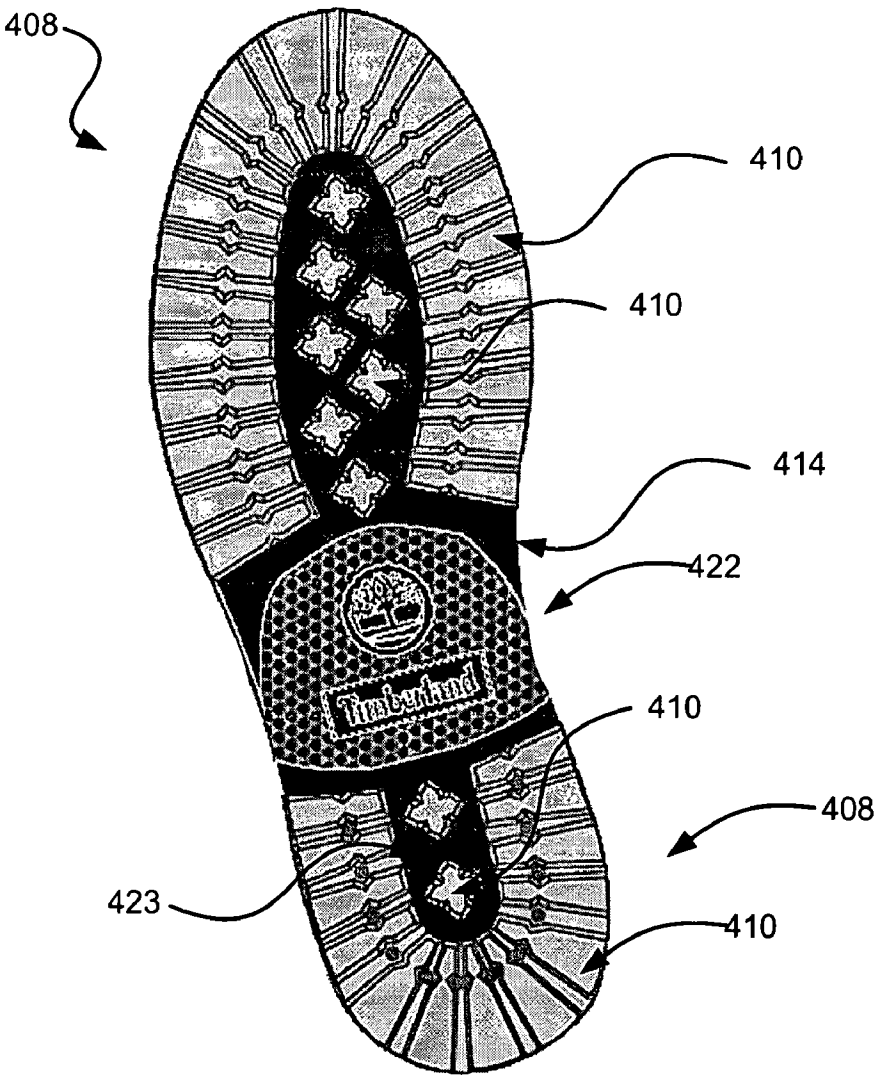
FIG. 5 depicts a bottom view of one embodiment of an article of footwear according to FIGS. 4A-B.

FIG. 5 depicts the bottom of the boot 400, illustrating the protective plate 423, the shovel guard 422, the midsole 414 and the outsole 408. The outsole 408 has a plurality of lugs 410. As shown in this figure, portions of the protective plate 423, shovel guard 422, and midsole 414 are exposed and visible.

Figures 6A, 6B, 6C:
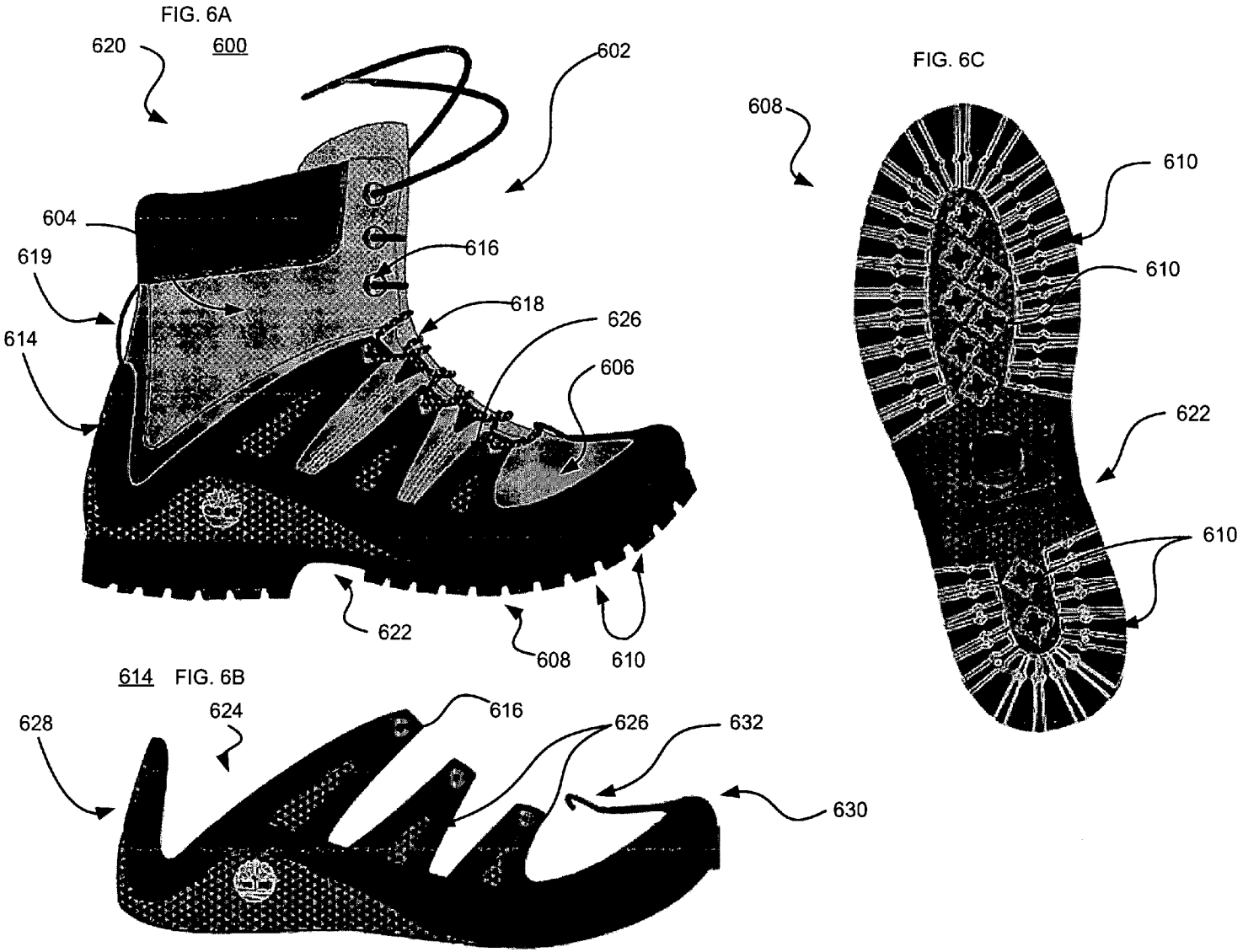
FIGS. 6A-C depict an alternate embodiment of an article of footwear according to the present invention.

FIG. 6A shows a further embodiment of an article of footwear 600 according to the present invention. The article of footwear 600 is similar to the article of footwear 400 discussed above, and preferably comprises a boot, although other styles of footwear are possible. The boot 600 has an upper 602 which includes a top region 604. The top region 604 is preferably made of a puncture and cut proof material as discussed earlier. The top region 604 may also be waterproof and fire retardant as discussed above. The upper 602 preferably also comprises a lower region 606 which may be made of leather or the same material as the top region 604. In one embodiment, the lower region 606 is waterproof while the upper region 604 is breathable but not waterproof, which makes the boot 600 waterproof in only certain depths of water, such as puddles. Here, top region 604 may include, for example, a mesh fabric or other permeable material, as well as one or more other layers of, for instance, padding. In one embodiment, the bottom third of the article of footwear 600 is waterproof while the rest of the article of footwear 600 is breathable and not waterproof. In another embodiment, the bottom quarter of the article of footwear 600 is waterproof. In yet another embodiment, the article of footwear 600 is waterproof only below the ankle portion or below the eyelets, for instance only along the lower region 606. The upper 602 preferably also comprises a collar 620 which provides comfort, for example, around the ankle region of the wearer. The top region 604 may include a plurality of eyelets 616 adapted to receive a lace 618 therethrough for securing the boot 600 to the foot of the user. The eyelets 616 are preferably translucent eyelets or alloy rivets. A strap 619 is preferably disposed on the heel or rear section of the upper 602 to facilitate donning and doffing of the boot 600.

As with the boot 400, the boot 600 preferably also comprises an outsole 608 with a plurality of lugs 610 for traction. The outsole 608 is desirably fabricated as a one piece unit. A shovel guard 622 may be integrally formed in the instep or arch region of the outsole 608, or may be a separate component attached to the outsole 608. The shovel guard 622 may be the same or similar to the shovel guards 26 and 422 discussed above, and preferably has a substantially flat bottom.

The boot 600 also desirably has a one piece rand or support cage 624 as depicted in FIG. 6B, with extended sections or 'fingers' 626 that extend over the mid and forefoot area of the upper 602 for added protection and foot security. This protective and structural support may preferably be a one piece rand or may be formed in sections. It may also be an integrally formed one piece 'foot cradle' 624 providing both the support and underfoot stability, serving as the midsole as well the upper support cage.

The support cage 624, in particular the fingers 626, heel member 628 and the toe region 630, is designed to enhance the fit and comfort of the boot 600. While three fingers 626 are shown in the side view of FIG. 6B, any number of fingers 626 may be used on the medial and lateral sides, including a single finger 626 on each side or a single finger 626 on only one side. Furthermore, the specific placement, dimensions and/or angles of the fingers 626 may differ from what is shown without departing from the spirit or scope of the invention.

The fingers 626 are preferably flexible enough to work independently, adjusting to the contours of the wearer's foot. This adaptability allows the article of footwear 600 to fit a large subject population having varying foot geometries, and works especially well in conjunction with adjustable footbeds as discussed herein. The fingers 626 enable fit adjustment, with an emphasis on foot instep adjustment as well as midfoot and forefoot width adjustment. The fit of articles of footwear 600 can accommodate variances in forefoot height and girth expected within the general population while providing a secure and comfortable fit for each wearer. Furthermore, the fingers 626 are able to accommodate variations among the left and right feet of the wearer. Some or all of the fingers 626 may include eyelets 616 thereon, so that the lace 618 can be adjusted in combination with the fingers 626 to achieve a desired fit. The toe region 630 may also include a hook, eyelet, lace loop or other fastener 632 for receiving or securing the lace 618.

FIG. 6C illustrates a bottom view of the article of footwear 600. Here, unlike the outsole 408, the protective plate/midsole 614 is covered by the one-piece outsole 608. However, it should be understood that the outsoles 408 and 608 may be used interchangeably, or other outsole configurations may also be employed with the articles of footwear 400 and 600.

Figures 7A, 7B, 7C:
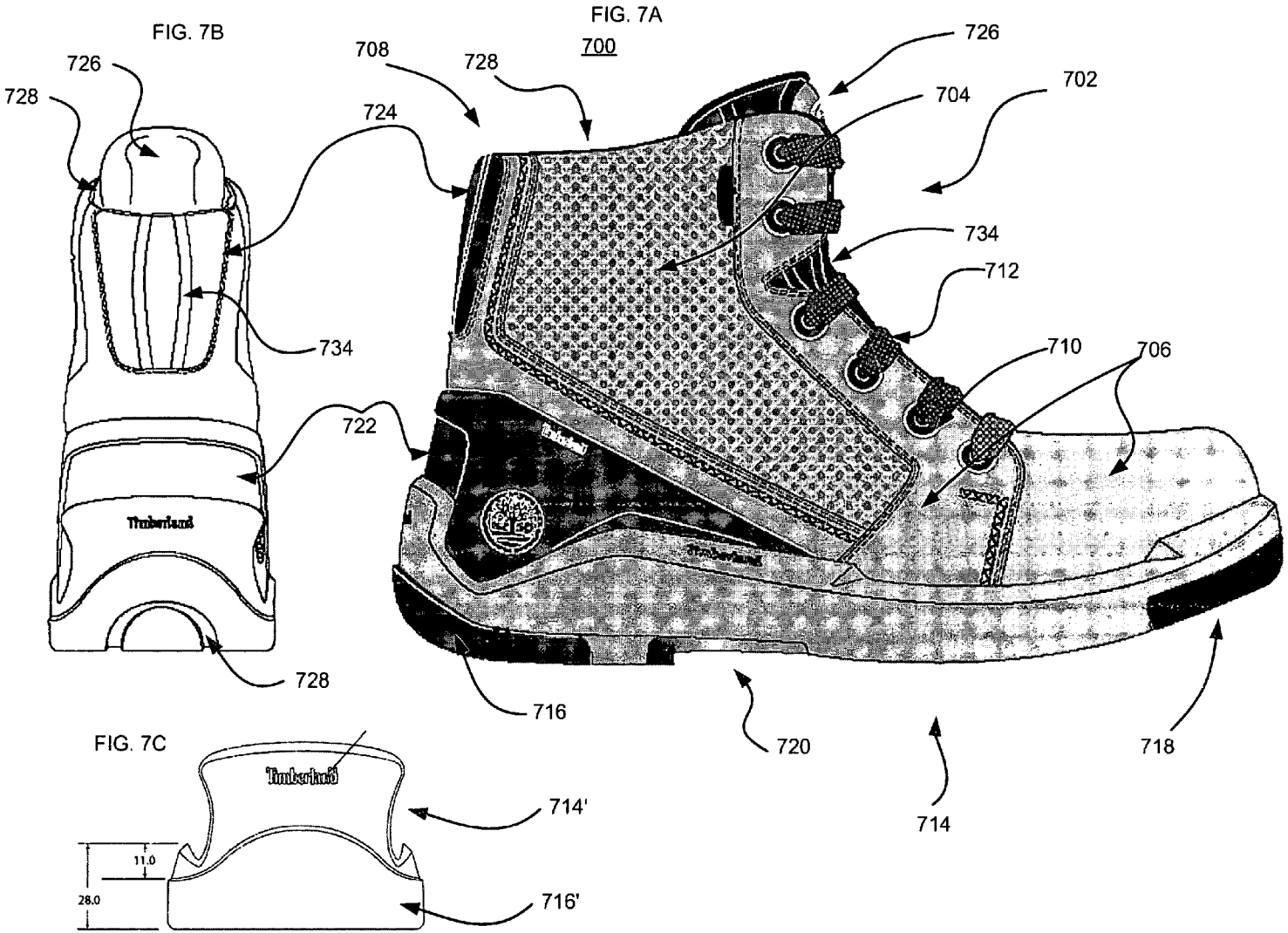
FIGS. 7A-G depict another embodiment of an article of footwear according to aspects of the present invention.

FIG. 7A shows another embodiment of an article of footwear 700 according to the present invention. The article of footwear 700 is generally similar to the articles of footwear 1, 400 and 600 discussed above, and preferably comprises a boot, although other styles of footwear are possible. The boot 700 has an upper 702 which regions of different material. As shown, the upper 702 includes regions 704 and 706. The region 704 is preferably made up of a puncture, cut proof or highly abrasion resistant material as discussed earlier. The region 704 may also be waterproof and fire retardant as discussed above. The region 706 may be made of leather or the same material as the region 704. In one embodiment, the region 706 is non-breathable and waterproof while the region 704 is breathable but not waterproof, which makes the boot 700 waterproof in only certain depths of water, such as puddles. Here, the region 704 may include, for example, a mesh fabric or other permeable material, as well as one or more other layers of, for instance, padding. In one embodiment, the bottom third of the article of footwear 700 is waterproof while the rest of the article of footwear 700 is breathable and not waterproof. In another embodiment, the bottom quarter of the article of footwear 700 is waterproof. The upper 702 preferably also comprises a collar region 708 along the top thereof, which forms an opening for receiving the wearer's foot. A plurality of eyelets 710 are adapted to receive a lace 712 therethrough for securing the boot 700 to the foot of the user. The eyelets 710 may be, e.g., rubber coated flat eyelets, translucent eyelets, or alloy rivets. In another embodiment the materials in the upper section may also be fire retardant or insulative for protection from heat or flame.

Outsole 714 is attached to the bottom of the upper 702. The outsole 714 is desirably fabricated as a one piece unit. The outsole 714 may be fabricated of natural or synthetic rubber, other materials as discussed herein, or any combination thereof. As shown, the outsole 714 includes a heel section 716 and a toe section 718. The heel section 716 and the toe section 718 preferably comprise a carbon-rubber compound, which is abrasion resistant and provides enhanced traction.

A shovel guard 720 is desirably positioned in the instep or arch region of the outsole 714, or may be integrally formed with the outsole 714. The shovel guard 720 may be the same or similar to the shovel guards 26, 422 and 622 discussed above, and preferably has a substantially flat bottom. A logo or other identifier may be encased in the shovel guard 720. See FIG. 8A.

A protective heel cover or heel rand 722, similar to the heel rand 29 or the protective heel cover 414, may also be included in the boot 700. Preferably, the protective heel cover 722 comprises TPU, although other materials as discussed herein may also be employed. Additionally, the protective heel cover 722 desirably incorporates a transparent shell with a metallic internal structure. A rubberized outer finish may be applied to at least a portion of the protective plate 722.

FIG. 7B is a rear view of the article of footwear 700, which illustrates heel section 724 and tongue section 726 of the upper, as well as the protective heel cover 722 and the outsole 714. In this view, the heel section 716 is shown as having a grooved or recessed segment 728. The segment 728 may be omitted, for instance as seen in the alternative rear view of outsole 714' in FIG. 7C, which shows heel section 716' without such a groove or recess.

In order to ventilate the foot and provide a more comfortable in-shoe environment, the upper 702 preferably includes one or more chimney structures, as disclosed in the aforementioned patent application entitled "Chimney Structures for Footwear and Foot Coverings." For instance, the upper 702 may include chimney structures in the medial and/or lateral quarter panels covered by the region 704. In this case, the chimney structures preferably vent out heat and/or moisture via the top line 728 of the upper.

Figures 7D, 7E:
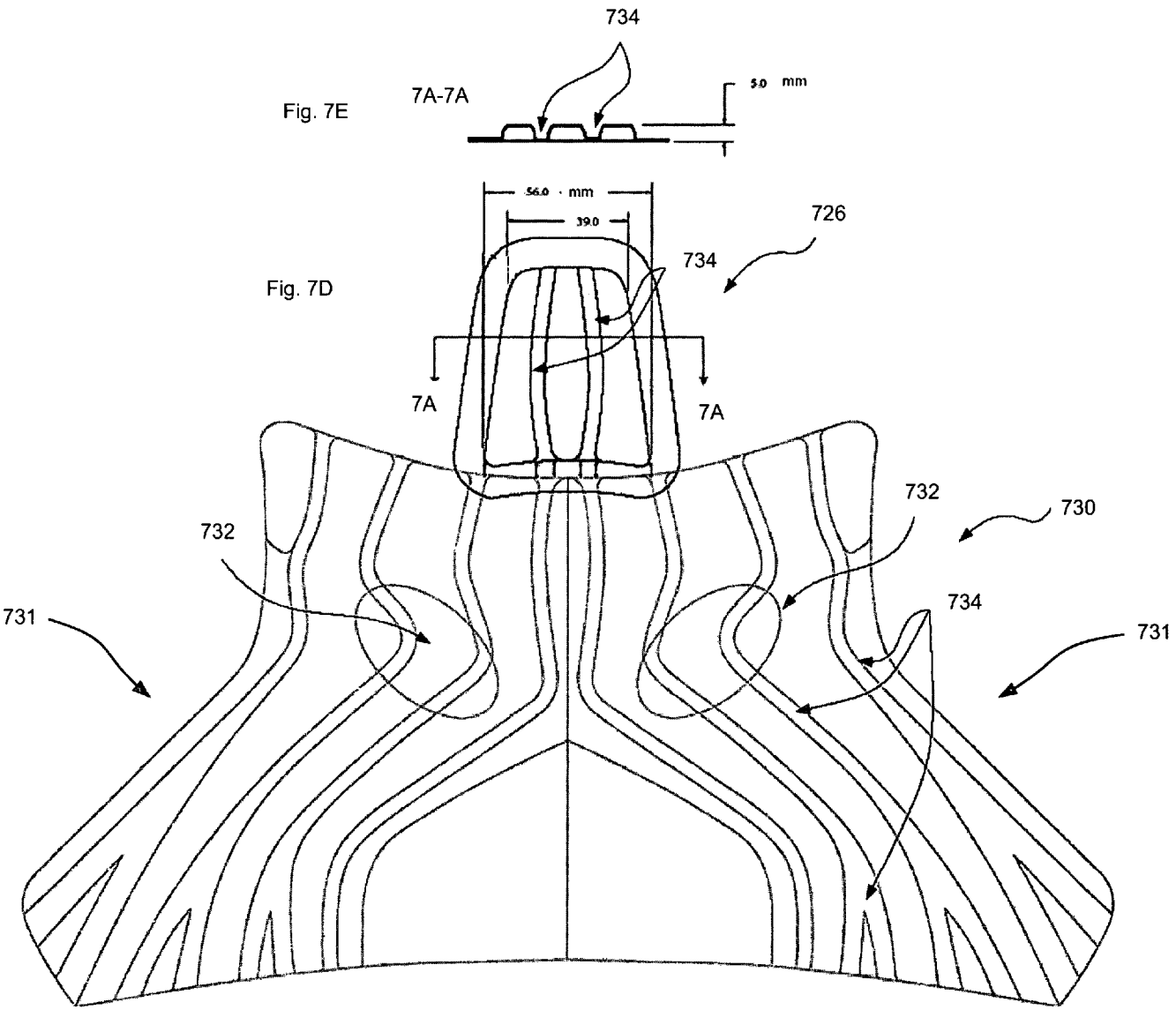

FIG. 7D shows a chimney system 730 that is preferably disposed within the upper 702. The chimney system 730 may be a removable insert of quarter panels 731, or may be sewn or otherwise permanently affixed in or as part of the upper 702. As seen in FIG. 7D, the chimney system 730 may include one or more regions 732, which may be padded or otherwise cushioned to minimize irritation of the wearer's foot or leg. For instance, the regions 732 may be oval shaped and placed about the ankle. In this case, the ankle regions 732 may be recesses in the chimney structure, padding such as a soft foam material, or a combination of both. Thus, chafing or irritation of the ankle is avoided. One or more chimneys 734 are disposed along the chimney system 730 for venting the heat and/or moisture.

Figures 7F, 7G:
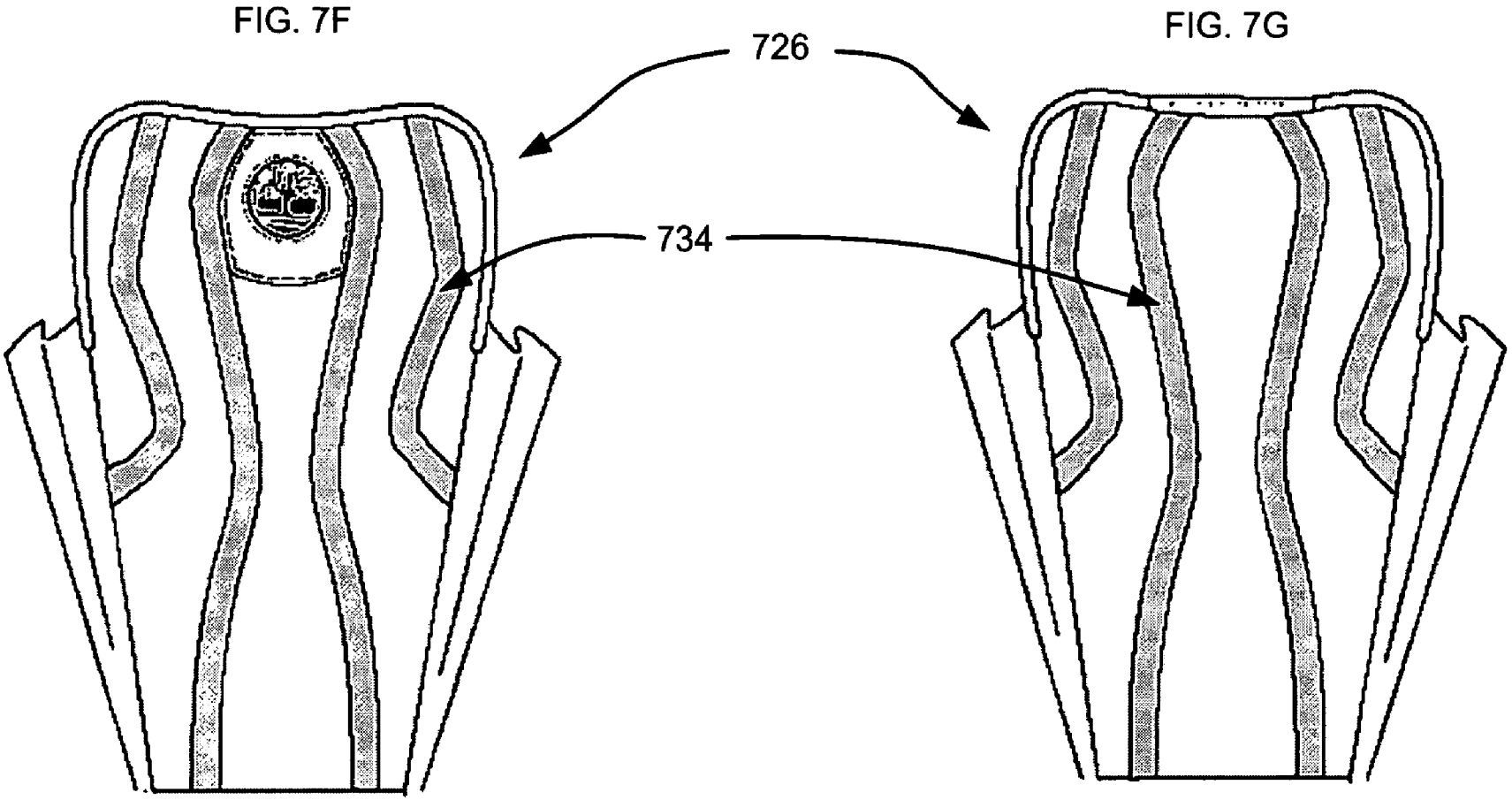

FIG. 7E illustrates a cutaway of the tongue 726 along line 7A-7A of FIG. 7D. FIGS. 7F and 7G illustrate front and rear views of the tongue 726, respectively, showing chimneys 734 disposed therein. Returning to FIG. 7B, it can be seen that the back/heel portion 724 of the upper 702 includes the chimneys 734 therein as well. Here, the chimneys 734 in the back/heel portion 724 may be separate from or incorporated into the chimneys 734 of the quarter panels shown in FIG. 7D.

Figures 8A, 8B, 8C, 8D:
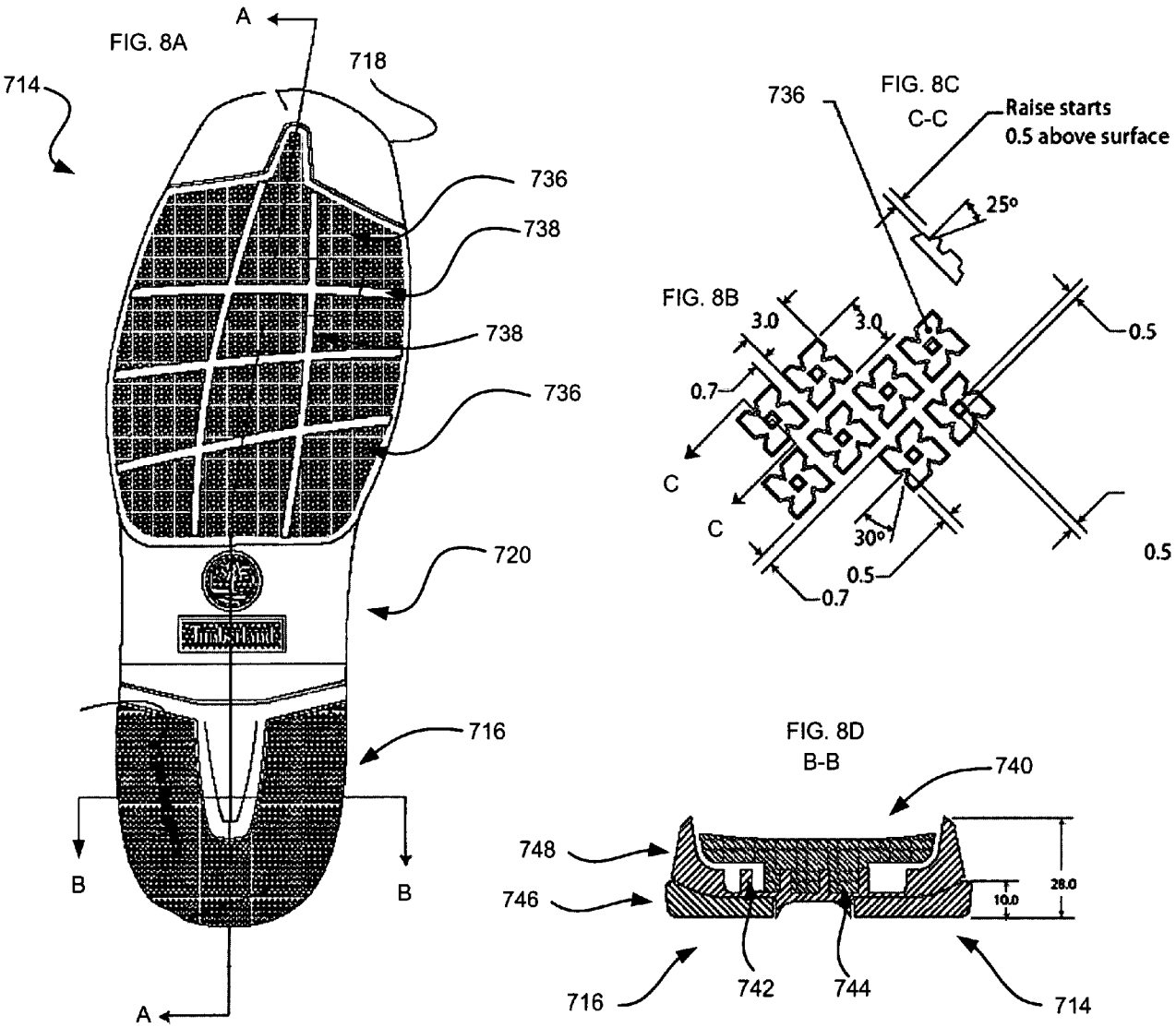
FIGS. 8A-F illustrate components of the article of footwear according to FIGS. 7A-G.

FIG. 8A is a bottom view of the outsole 714, showing the heel section 716, the toe section 718, and the shovel guard 720 in more detail. As seen in this figure, the outsole 714 preferably also includes traction elements or lugs 736 therein. The traction elements 736 may be disposed in one or more sections, that may be separated by segments or grooves 738, which are desirably flex grooves that enable the outsole 714 to flex during wear. FIG. 8B is a close-up view some of the traction elements 736, and FIG. 8C is a cutaway view along the C-C line of FIG. 8B. The traction elements 736 are desirably star-shaped lugs, which are preferably 2 mm or less in overall height, more preferably between 0.5 and 1.5 mm in overall height.

FIG. 8D is a cutaway view of the outsole 714 along the B-B line of FIG. 8A, showing the heel section 716 and midsole 740. The midsole 740 may be a distinct element or may be incorporated as part of the protective plate 722. As shown, the heel section 716 may include internal members 742 such as ridges or projections, and the midsole 740 may include base members 744 in reciprocal arrangement thereto in order to provide a secure engagement between the midsole 740 and the heel section 716 of the outsole 714.

Figure 8F:
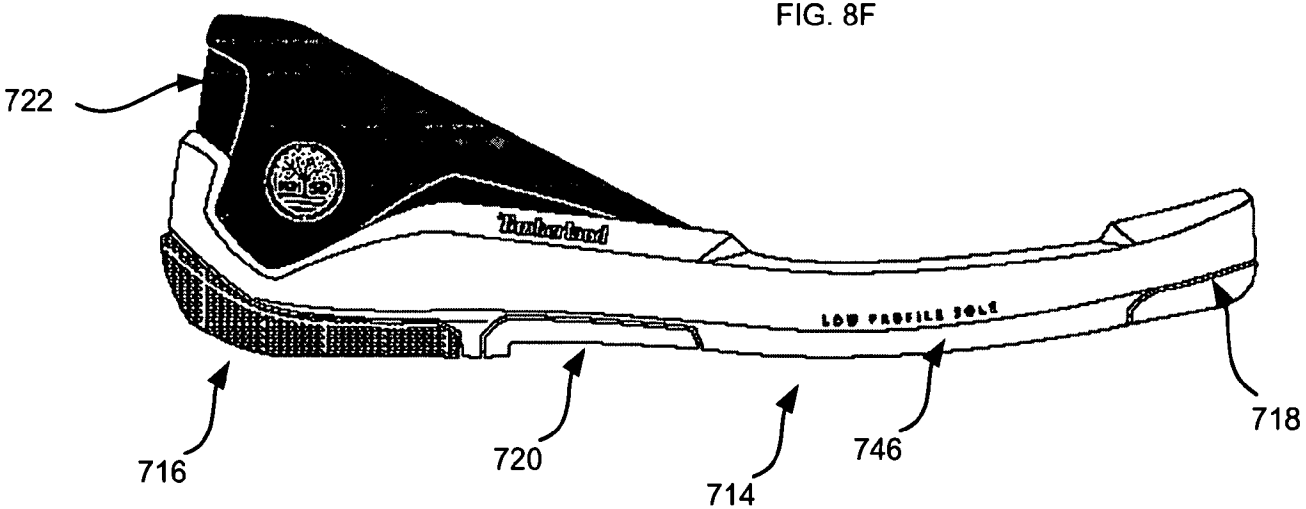
Figure 8E:
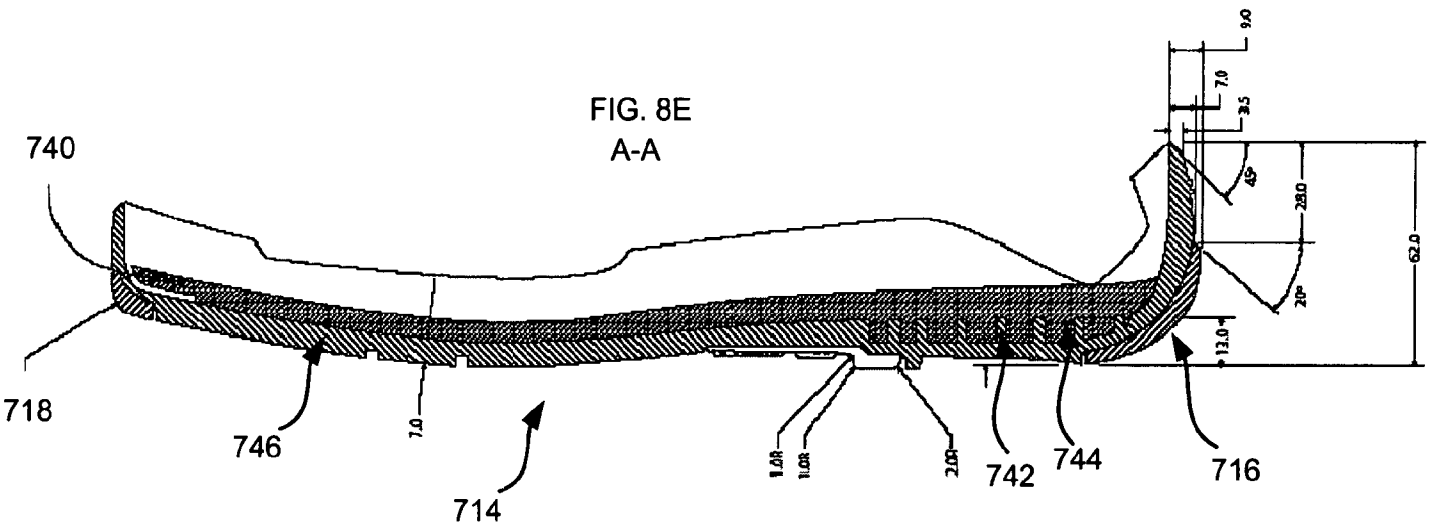

FIG. 8E depicts a cross section view of the outsole 714 along the A-A line of FIG. 8A. The members 742 and 744 of the outsole 714 and the midsole 740 are shown in the heel regions of these two components. Of course, it should be understood that the members 742 and 744 may be disposed anywhere along the length of the outsole 714 and the midsole 740, respectively. As seen in FIGS. 8D and 8E, the outsole 714 preferably has a low-profile, which provides the wearer with greater stability due, in part, to a low center of gravity. Traditional work boots have an elevated heel section, shifting the center of gravity of the wearer slightly forward. A lower profile is more advantageous for the wearer in environments such as construction or service work where balance is critical while engaged in labor. Ground contacting portion 746 of the outsole 714 is desirably low profile, preferably on the order of 15 mm or less, for instance between about 8 and 13 mm thick. More preferably, as seen in FIG. 8D, the ground contacting portion 746 is preferably 10 mm or less in thickness. Sidewalls 748 preferably have an overall height of less than about 40 mm, more preferably about 28 mm or less. The heel of the outsole 714, as seen in FIG. 8E, is preferably on the order of 70 mm in height or less, for instance about 0-65 mm in height. FIG. 8F illustrates a side view of the outsole 714 and the protective heel cover 722 without the upper 702. As seen here, the protective heel cover 722 extends from the instep region of the boot 700 to the heel region thereof.

Figure 9A:
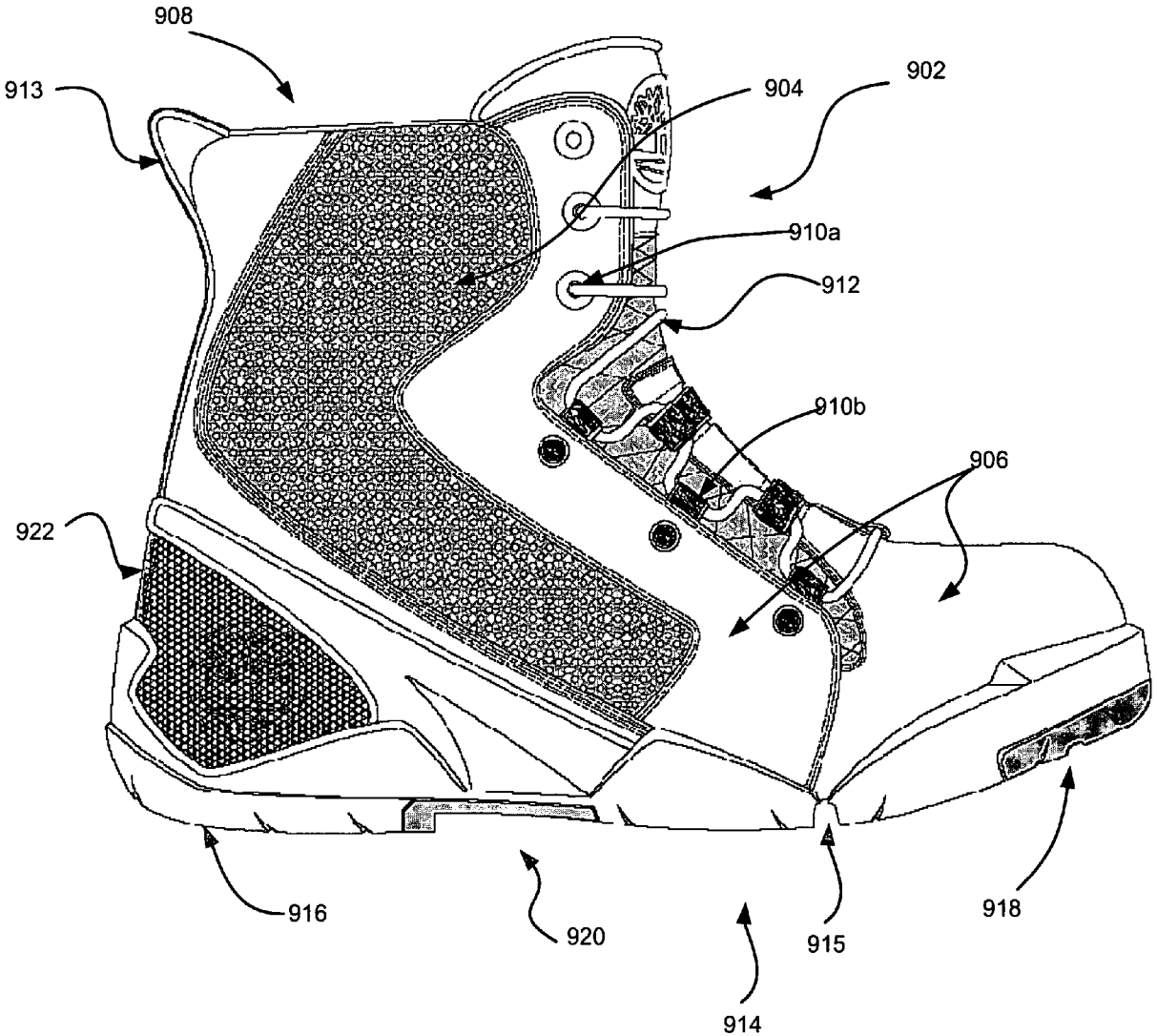
FIGS. 9A-E depict an alternate embodiment of an article of footwear according to the present invention.

FIG. 9A shows another embodiment of an article of footwear 900 according to the present invention. The article of footwear 700 is generally similar to the articles of footwear 1, 400, 600 and 700 discussed above, and preferably comprises a boot, although other styles of footwear are possible. The boot 900 has an upper 902 with regions of different material. As shown, the upper 902 includes regions 904 and 906. The region 904 is preferably made up of a puncture, abrasion resistant, or cut proof material as discussed earlier. The region 904 may also be waterproof and fire retardant as discussed above. The region 906 may be made of leather or the same material as the region 904. In one embodiment, the region 906 is non-breathable and waterproof while the region 904 is breathable but not waterproof, which makes the boot 900 waterproof in only certain depths of water, such as puddles. Here, the region 904 may include, for example, a mesh fabric or other permeable material, as well as one or more other layers of, for instance, padding. In one embodiment, the bottom third of the article of footwear 900 is waterproof while the rest of the article of footwear 900 is breathable and not waterproof. In another embodiment, the bottom quarter of the article of footwear 900 is waterproof. The upper 902 preferably also comprises a collar region 908 along the top thereof, which forms an opening for receiving the wearer's foot. A plurality of eyelets or other fasteners or receptacles 910 are adapted to receive a lace 912 therethrough for securing the boot 900 to the foot of the user. Eyelets 910*a* may be, for example, rubber coated flat eyelets, translucent eyelets, or alloy rivets. Other receptacles 910*b* may be nylon, plastic or another material. At least some of the eyelets 910 are preferably disposed along an eyestay section of the region 906. The boot 900 preferably also comprises a pull loop 913 which allows the user to pull the boot 900 on and off with ease.

Outsole 914 is desirably attached to the bottom of the upper 902. The outsole 914 is desirably fabricated as a multi-piece unit. A space, gap, or notch 915 may partly or fully separate the forefoot portion of the outsole 914 from the rest of the outsole 914. The space 915 gives the outsole 914 and the boot 900 in general greater flexibility when the wearer is walking, bending, etc. The outsole 914 may be fabricated of natural or synthetic rubber, other materials as discussed herein, or any combination thereof. As shown, the outsole 914 includes a heel section 916 and a toe section 918. One or both of the heel section 916 and the toe section 918 preferably comprise a carbon-rubber compound, which is abrasion resistant and provides enhanced traction.

A shovel guard 920 is desirably positioned in the instep or arch region of the outsole 914, or may be integrally formed with the outsole 914. The shovel guard 920 may be the same or similar to the shovel guards 26, 422, 622 and 720 discussed above, and preferably has a substantially flat bottom. A logo or other identifier may be encased in the shovel guard 920, as seen in the bottom view of FIG. 9B.

As shown in FIG. 9A, a protective heel cover or heel rand 922, similar to the heel rand 29 or the protective heel covers 414 and 722 may also be included in the boot 900. Preferably, the protective heel cover 922 comprises TPU, although other materials as discussed herein may also be employed. As with the protective heel cover 722, the protective heel cover 922 may incorporate a transparent shell with a metallic internal structure, and a rubberized outer finish may be applied to at least a portion of the protective heel cover 922.

Figures 9B, 9C, 9D:
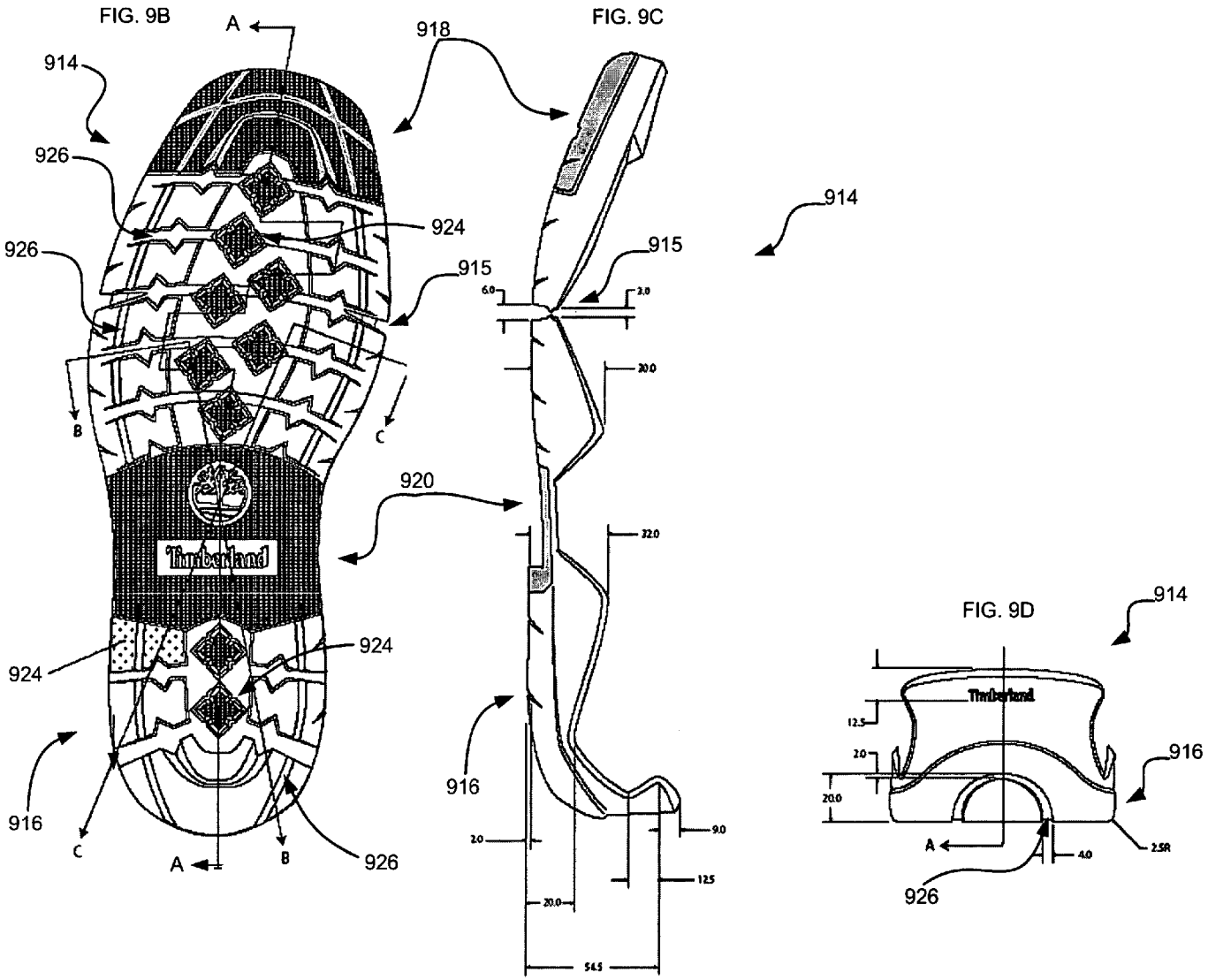

The heel section 916 and the toe section 918 of the outsole 914, as well as the shovel guard 920 are illustrated in more detail in the bottom view of FIG. 9B. As seen in this figure, the outsole 914 preferably also includes traction elements or lugs 924 thereon. The traction elements 924 may be disposed in one or more sections, and one or more segments, grooves or siping 926 may also be disposed in the outsole 914. The segments, grooves or siping 926 may be incorporated to permit the outsole 914 to flex during wear.

FIGS. 9C and 9D are side and rear views of the outsole 914, respectively. The outsole 914 is preferably a one-piece unit of, e.g., rubber, with grooves in the side wall of the forefoot area on the medial and lateral sides thereof for flexibility. Toe section 918, although part of the one piece outsole 914, has an increased durometer or hardness as compared to the materials of the other portions of the outsole 914. The increased durometer or hardness is for increased protection for use of the toe tool as discussed herein.

Figure 9E:
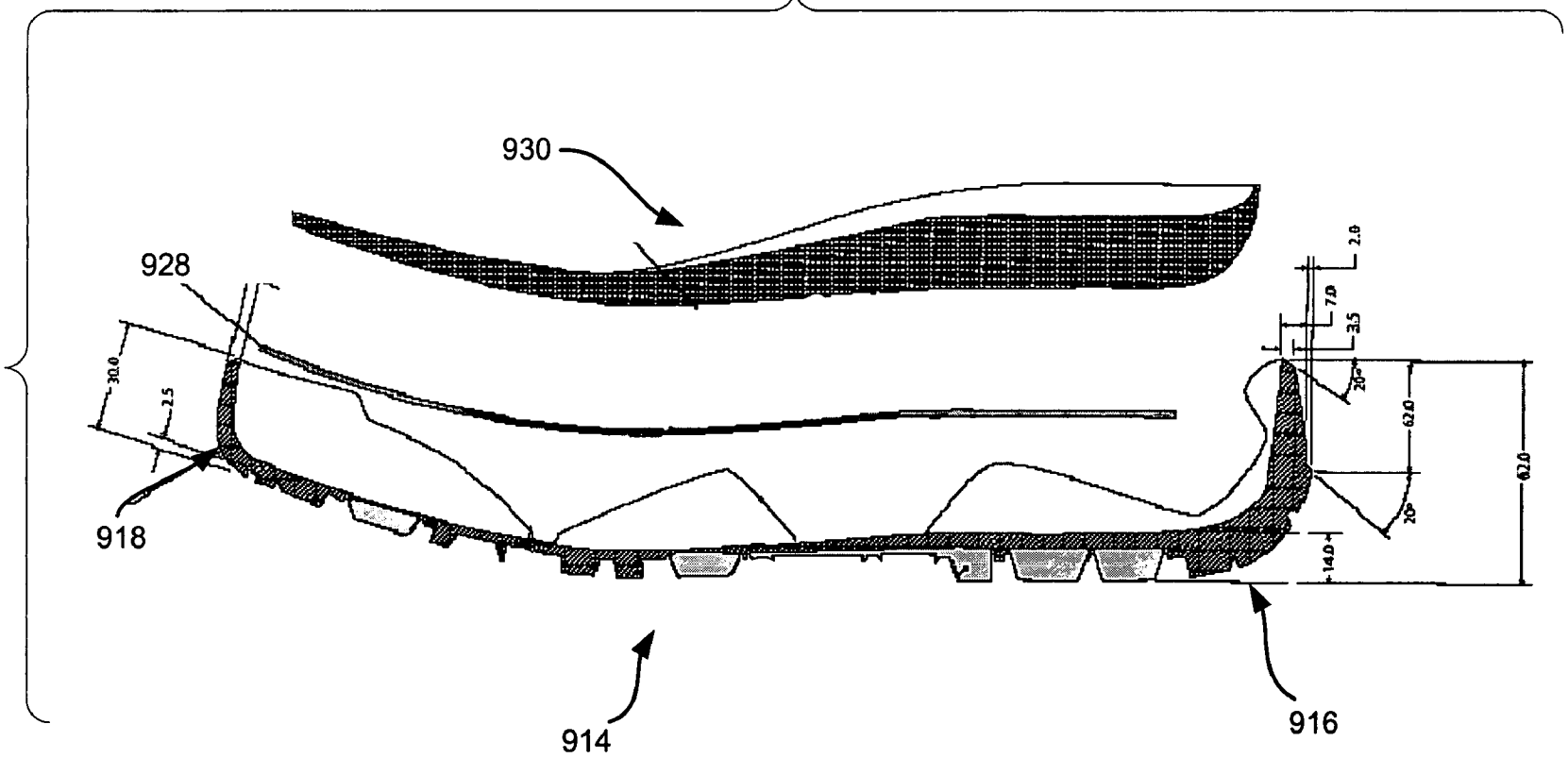

FIG. 9E is a view of the outsole 914 along the A-A line of FIG. 9B. This exploded view also illustrates a steel plate 928 and a midsole 930 that may be disposed over the outsole 914.

Figures 10A, 10B, 10C:
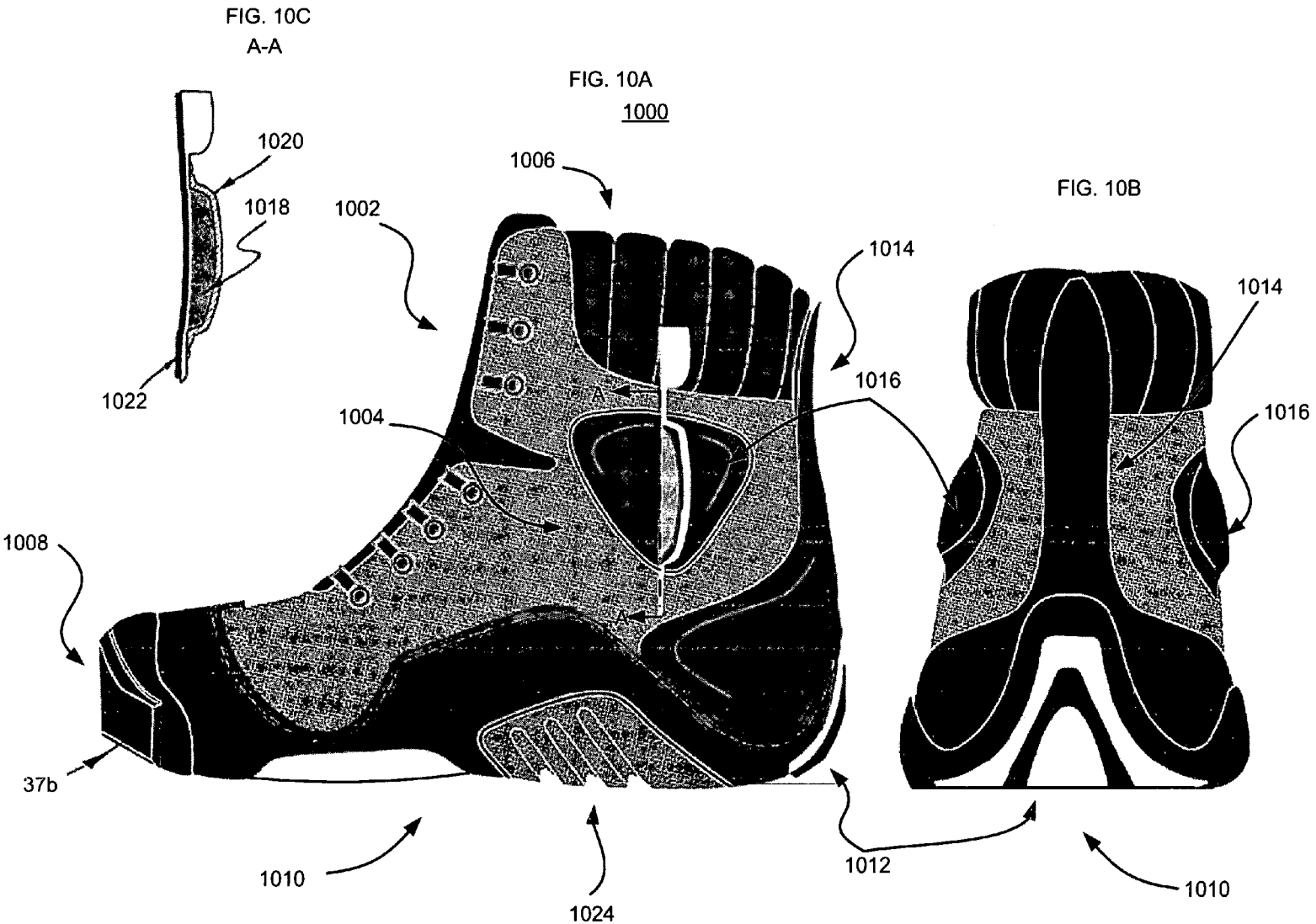
FIGS. 10A-C illustrate another embodiment of an article of footwear in accordance with aspects of the present invention.

FIGS. 10A-B show side and rear views of yet another embodiment of an article of footwear 1000 according to the present invention. The article of footwear 1000 preferably comprises a boot, although other designs and styles of footwear may be employed. The boot 1000 preferably has an upper 1002 including an outer housing 1004 as well as a collar 1006. The outer housing 1004 may comprise any of the materials used in uppers as described herein. The upper 1002 may incorporate chimney structures as described above in the quarter panels of the outer housing 1004, along the collar 1006, or elsewhere. The boot 1000 preferably includes a toe tool 1008 as discussed above with regard to FIGS. 3A and 3B.

An outsole 1010 is disposed beneath the upper 1002. The outsole 1010 preferably includes a heel portion 1012 that is curved from the bottom of the outsole 1010 of the boot 1000 to the rear section of the upper 1002. The boot 1000 may also have a heel guard or protective reinforcement such as heel guard 1014 is desirably placed on the rear of the article of footwear 1000. The heel guard 1014 may be formed of one or more segments or pieces, and may include piping, reflective tape, colorant and/or a reflective label or indicator (not shown) that can indicate the size of the article of footwear 1000 or other information. The heel guard 1014 preferably extends substantially or entirely up the rear surface of the upper 1002. The heel guard 1014 may be made of, for example, rubber or plastic. The heel guard 1014 lends support to the structure of the boot 1000 and offers protection to the foot of the wearer from rear impact. The boot 1000 preferably also includes an ankle protector 1016.

A cross section of the ankle protector 1016 and adjacent portions of the boot 1000 are depicted along the A-A line of FIG. 10A, are shown in FIG. 10C. The ankle protector 1016 may be placed on the interior of the upper 1002, between layers of the upper 1002, and/or on the outer housing 1004 of the upper 1002. The ankle protector 1016 may be on the medial and/or the lateral sides of the upper 1002. Preferably, the ankle protector 1016 is located at least on the lateral side. In one example, the ankle protector 1016 comprises one or more layers of padding 1018, such as foam padding or felt in combination with a durable material such as leather. As seen in the cutaway view, the ankle protector 1016 may include an outer cover or shell 1020, the padding 1018, and an inner lining 1022. The ankle protector 1006 protects the wearer of the boot 1000 from side impact, such as from hammers, flying debris, or broken glass.

Returning to FIG. 10A, the boot 1000 may include one or more recesses or grooves 1024 on a portion of the outsole 1010. The outsole 1010 is an example of a low profile outsole for increased traction and stability for the wearer under conditions typically found in construction or service work environments. However, the outsole 1010 is suitable for use in many other environments and conditions in addition to those enumerated herein.

Figure 11B:
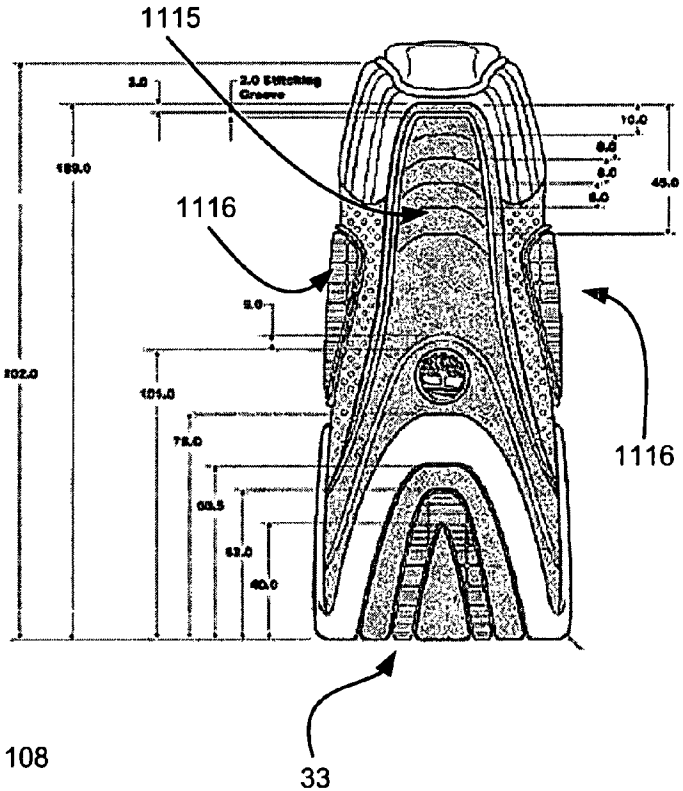
FIGS. 11A-G illustrate a further embodiment of an article of footwear in accordance with aspects of the present invention.
Figure 11A:
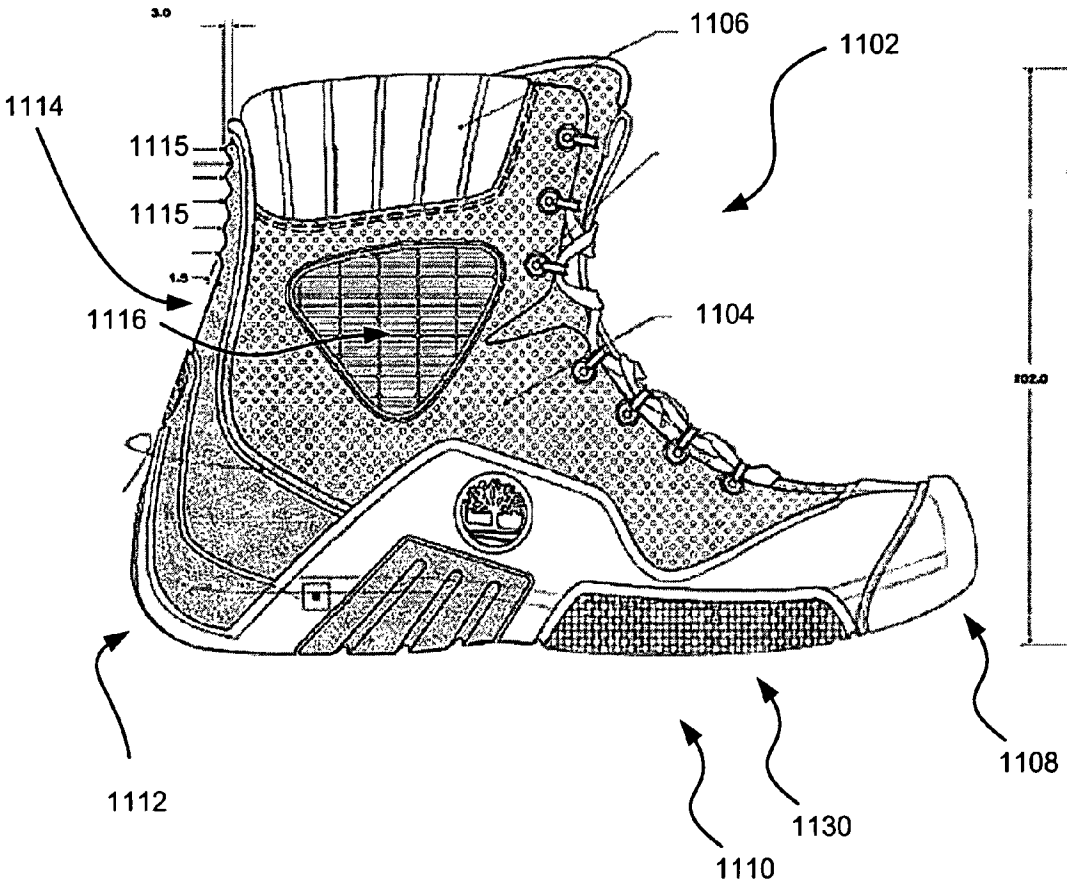

FIGS. 11A-B show side and rear views of a further embodiment of an article of footwear 1100 according to the present invention. The article of footwear 1100 is similar to the article of footwear 1000, and preferably comprises a boot, although other designs and styles of footwear may be employed. As with the boot 1000, the boot 1100 preferably has an upper 1102 including an outer housing 1004 as well as a collar 1006. The outer housing 1104 may comprise any of the materials used in uppers as described herein. The upper 1102 may incorporate chimney structures as described above in the quarter panels of the outer housing 1104, along the collar 1106, or elsewhere. The boot 1100 preferably includes a toe tool 1108 as discussed above with regard to FIGS. 2A-C.

An outsole 1110 is disposed beneath the upper 1102. The outsole 1110 preferably includes a heel portion 1112 that is curved from the bottom of the outsole 1110 of the boot 1100 to the rear section of the upper 1102. The boot 1100 may also have a heel guard or protective reinforcement such as heel guard 1114 is desirably placed on the rear of the article of footwear 1000. The heel guard 1114 may be formed of one or more segments or pieces, and may include piping, reflective tape and/or a reflective label or indicator (not shown) that can indicate the size of the article of footwear 1100 or other information. The heel guard 1114 preferably extends substantially or entirely up the rear surface of the upper 1102. The heel guard 1114 may be made of, for example, rubber or plastic. The heel guard 1114 lends support to the structure of the boot 1100 and offers protection to the foot of the wearer from rear impact. The heel guard 1114 may also include one or more dimples, grooves or recesses 1115 along the back portion thereof, for example in column form or as a series of rows, which can provide the heel guard 1114 and/or the collar 1106 with enhanced flexibility or in the case of the collar 1106, traction for better grip. The boot 1000 preferably also includes an ankle protector 1116 that is desirably the same as described above with respect to the ankle protector 1016.

Figure 11G:
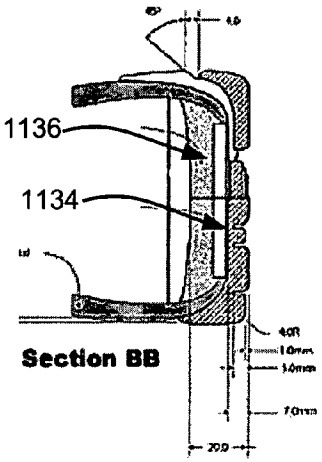
Figure 11E:
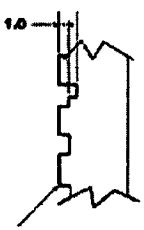
Figure 11D:
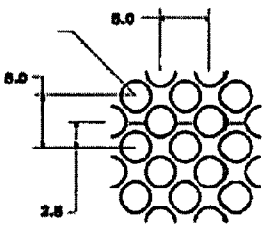
Figure 11C:
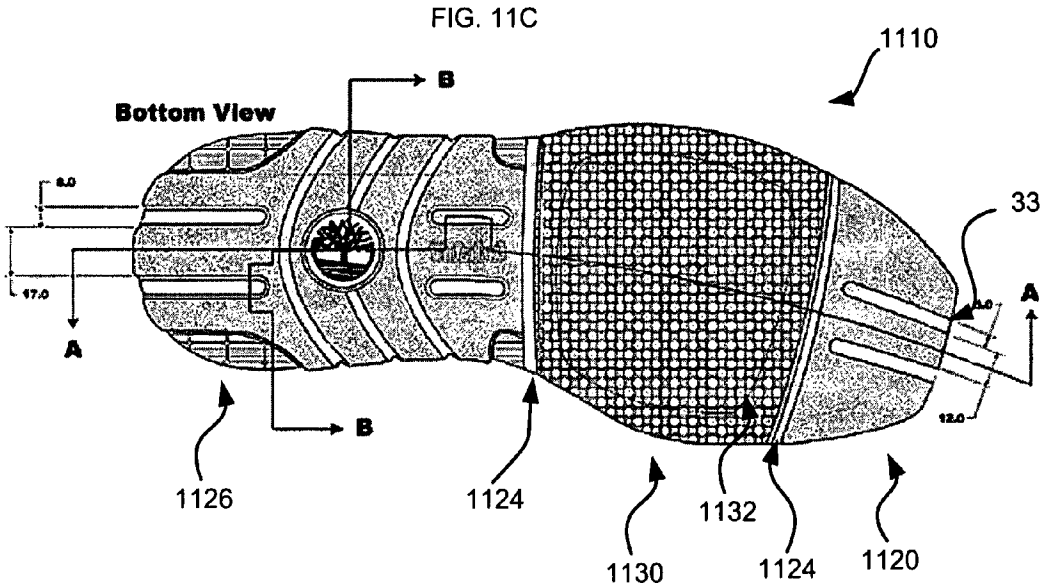

As seen in FIG. 11A and the bottom view of FIG. 11C, the boot 1100 may include one or more recesses or grooves 1124 on a portion of the low profile outsole 1110. The recesses/grooves 1124 are preferably flex grooves.

The outsole 1110 is preferably a low profile outsole, which provides increased traction on multiple work surfaces, such as ladders, 2×4 wooden beams, steel beams, uneven terrain, etc. As shown in the side profile of FIG. 11A, the outsole 1110 is substantially planar, having a "non-breasted heel" that follows in line with the midfoot and forefoot sections of the outsole, in contrast to boots which have a separate, breasted heel. FIG. 11C shows heel section 1126, toe section 1120, and forefoot section 1130 of the outsole 1110 in more detail. As seen in this figure, the outsole 1110 preferably also includes traction elements or lugs 1132 on the forefoot section 1130. The traction elements 1132 desirably wrap upwards on the medial and/or lateral sides of the outsole. See FIG. 11A. The traction elements 1132 are shown as a single region, but may be disposed in one or more sections that may be separated by segments or grooves (not shown), which are desirably flex grooves that enable the outsole 1110 to flex during wear. The forefoot section 1130, and in particular the traction elements 1132, may be colored or reflective for safety. This provides a visual queue so that a worker can, at a glance, look down and know his or her foot is firmly placed on a work surface.

FIG. 11D is a close-up view and FIG. 11E is a side view of some of the traction elements 1132. The traction elements 1132 are desirably generally circular in shape, and may be on the order of 5 mm in diameter, such as between about 3-8 mm in diameter. The traction elements 1132 are preferably 2 mm or less in overall height, more preferably between 0.25 and 1.5 mm in overall height. The low height traction elements 1132 are desirable with a low profile outsole 1110; however, the traction elements 1132 still provide a firm grip on the work surface. Furthermore, traditional lugs often catch on protrusions or materials on work surfaces. Here, the low profile traction elements 1132 and/or flat or substantially planar surfaces on the bottom of the outsole 1110 minimize unsure footing while providing superior traction upon surface contact.

Figure 11F:
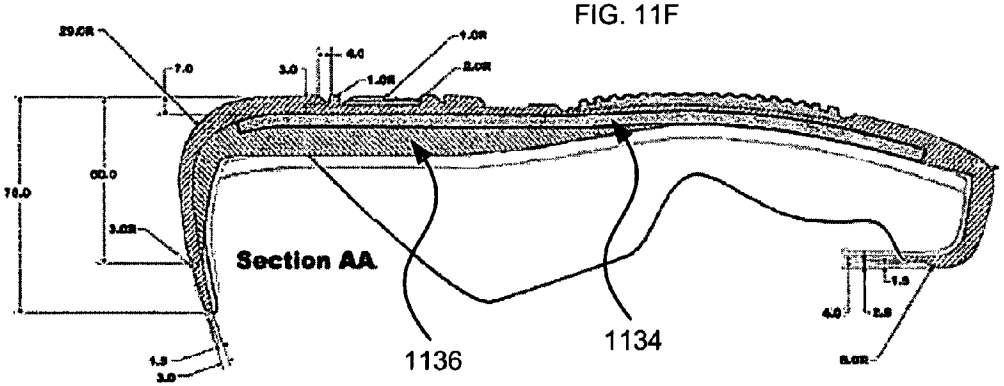

FIG. 11F is a cutaway view of the outsole 1110 along the A-A line of FIG. 11C, and FIG. 11G is a cutaway view of the outsole 1110 along the B-B line of FIG. 11C. As seen in these views, a plate 1134 may be disposed on the outsole 1110. The plate 1134 may provide, for example, puncture resistance, thermal insulation, etc. Midsole 1136 is preferably disposed over the plate 1134, and may partially surround it.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims. By way of example only, while different embodiments described above illustrate specific features, it is within the scope of the present invention to combine or interchange different features among the various embodiments to create other variants. Any of the features in any of the embodiments can be combined or interchanged with any other features in any of the other embodiments. For instance, any of the outsole configurations may be utilized with any of the articles of footwear. The protective plates illustrated in some embodiments may be employed in any of the other embodiments. The layers, regions or zones of different material may be utilized or combined in any of the ways enumerated here, although other combinations are also within the scope of the invention. The shovel guards, structural support cages, toe tools and/or chimney convection ventilation structures may be utilized alone, or in any combination with other features disclosed herein.

The invention claimed is:

1. An article of footwear, comprising:

an outsole having a first surface for contacting the ground and having traction elements thereon and a second surface remote from the first surface;

an upper attached to the second surface of the outsole, the upper including a shaft section and a base section, the shaft section substantially encircling a portion of the wearer's leg and the base section forming an enclosure region for the wearer's foot;

a shovel guard of rigid material disposed on an instep section of the article of footwear adjacent to the outsole; and a toe tool disposed along a toe section of the article of footwear and having a substantially planar exterior front surface;

wherein the toe tool is integral with a midsole member of the article of footwear.

2. The article of footwear of claim 1, wherein the shovel guard extends substantially from the medial side to the lateral side of the article of footwear.

3. The article of footwear of claim 2, wherein the shovel guard is formed on the instep section between a forefoot section of the outsole and a rearfoot section of the outsole, the shovel guard not including any of the traction elements thereon.

4. The article of footwear of claim 1, wherein the substantially planar exterior front surface is generally perpendicular to the shovel guard.

5. The article of footwear of claim 4, wherein the toe tool further includes generally planar first and second side surfaces disposed on either side of the front surface.

6. The article of footwear of claim 1, further including a protective heel cover disposed along a heel section of the upper, the protective heel cover comprising a rigid material.

7. The article of footwear of claim 6, wherein medial and lateral sides of the outsole wrap upwards along at least insole and metatarsal regions of the article of footwear, at least some of the traction elements being disposed on the upwardly wrapped medial and lateral sides of the outsole.

8. The article of footwear of claim 6, wherein at least a portion of the protective heel cover includes a rubberized outer finish thereon.

9. The article of footwear of claim 1, further comprising an ankle protector on at least one of the medial and lateral sides of the upper shaft.

10. An article of footwear, comprising:

an outsole having a first surface for contacting the ground and having traction elements thereon and a second surface remote from the first surface;

an upper attached to the second surface of the outsole, the upper including a shaft section and a base section, the shaft section substantially encircling a portion of the wearer's leg and the base section forming an enclosure region for the wearer's foot;

a shovel guard of rigid material disposed on an instep section of the article of footwear adjacent to the outsole; and a toe tool disposed along a toe section of the article of footwear and having a substantially planar exterior front surface;

wherein medial and lateral sides of the outsole wrap upwards along at least insole and metatarsal regions of the article of footwear, at least some of the traction elements being disposed on the upwardly wrapped medial and lateral sides of the outsole.

11. The article of footwear of claim 10, wherein the shovel guard extends substantially from the medial side to the lateral side of the article of footwear.

12. The article of footwear of claim 11, wherein the shovel guard is formed on the instep section between a forefoot section of the outsole and a rearfoot section of the outsole, the shovel guard not including any of the traction elements thereon.

13. The article of footwear of claim 10, wherein the toe tool is integral with the outsole.

14. The article of footwear of claim 10, wherein the toe tool is integral with a midsole member of the article of footwear.

15. The article of footwear of claim 10, wherein the substantially planar exterior front surface is generally perpendicular to the shovel guard.

16. The article of footwear of claim 15, wherein the toe tool further includes generally planar first and second side surfaces disposed on either side of the front surface.

17. The article of footwear of claim 10, further including a protective heel cover disposed along a heel section of the upper, the protective heel cover comprising a rigid material.

18. The article of footwear of claim 17, wherein at least a portion of the protective heel cover includes a rubberized outer finish thereon.

19. The article of footwear of claim 10, further comprising an ankle protector on at least one of the medial and lateral sides of the upper shaft.

* * * * *